US008601635B2

(12) United States Patent
Goldman et al.

(10) Patent No.: US 8,601,635 B2
(45) Date of Patent: Dec. 10, 2013

(54) ORAL CARE DEVICE

(75) Inventors: Paul David Goldman, Marlboro, MA (US); Mark Edward Farrell, Medfield, MA (US); Paul Albert Sagel, Maineville, OH (US)

(73) Assignee: The Gillette Company, Boston, MA (US)

( * ) Notice: Subject to any disclaimer, the term of this patent is extended or adjusted under 35 U.S.C. 154(b) by 316 days.

(21) Appl. No.: 13/101,750

(22) Filed: May 5, 2011

(65) Prior Publication Data

US 2011/0271473 A1 Nov. 10, 2011

Related U.S. Application Data

(60) Provisional application No. 61/332,344, filed on May 7, 2010.

(51) Int. Cl.
*A46B 9/04* (2006.01)

(52) U.S. Cl.
USPC ..... 15/167.1; 15/201

(58) Field of Classification Search
USPC ..... 15/167.1, 201
See application file for complete search history.

(56) References Cited

U.S. PATENT DOCUMENTS

| | | | | |
|---|---|---|---|---|
| 4,370,314 | A * | 1/1983 | Gaffar | 424/54 |
| 5,355,546 | A | 10/1994 | Scheier et al. | |
| 5,799,354 | A | 9/1998 | Amir | |
| 8,075,216 | B2 * | 12/2011 | Gatzemeyer et al. | 401/288 |
| 8,282,298 | B2 * | 10/2012 | Robinson et al. | 401/132 |
| 8,393,042 | B2 * | 3/2013 | Moskovich et al. | 15/167.1 |
| 2004/0117934 | A1 | 6/2004 | Pfenniger et al. | |
| 2008/0181716 | A1 | 7/2008 | Gatzemeyer et al. | |

OTHER PUBLICATIONS

PCT International Search Report dated Oct. 7, 2011.

* cited by examiner

*Primary Examiner* — Shay Karls
(74) *Attorney, Agent, or Firm* — George Henry Leal; Vladimir Vitenberg

(57) ABSTRACT

An oral care implement having a handle and a toothbrush head is disclosed. The head includes a base portion and a cleaning portion. The cleaning portion includes a plurality of cleaning elements, wherein the cleaning portion is attached to the base portion at a first end and a second end. A mid-section of the cleaning portion is elevated above the base portion such that an opening is created between the base portion and the cleaning portion, and wherein the opening extends along a longitudinal axis of the head.

21 Claims, 14 Drawing Sheets

ORAL CARE DEVICE

CROSS REFERENCE OF RELATED APPLICATION

This application claims the benefit of provisional application Ser. No. 61/332,344, filed on May 7, 2010, which is incorporated by reference in its entirety herein.

FIELD OF THE INVENTION

The present invention pertains to a personal hygiene device, more particularly to an oral care device.

BACKGROUND OF THE INVENTION

Over the past several years, an attempt has been made to make toothbrushes which better conform to the curvature of the teeth in the oral cavity. It is believed that by closely following the curvature of the oral cavity better cleaning may occur.

As such, there is a need for a toothbrush which can conform to the curvature of the teeth within the oral cavity.

SUMMARY OF THE INVENTION

The oral care device of the present invention may adapt to the curvature of teeth of a user and provide the user with additional comfort. An oral care device may be in the form of a toothbrush either manual or electric. In some embodiments, a toothbrush head may comprise a base portion and a cleaning portion. The cleaning portion may comprise a plurality of cleaning elements, wherein the cleaning portion is attached to the base portion at a first end and a second end. A mid-section of the cleaning portion is elevated above the base portion such that an opening is created between the base portion and the cleaning portion, and wherein the opening extends along a longitudinal axis of the head.

In some embodiments, a toothbrush head may comprise a base support and a cleaning portion. The base support may include a free end and an attachment end, and a first surface and a second surface. The cleaning portion may include a first end and a second end. The first end and the second end may be attached to the base support. A mid section of the cleaning portion may be elevated above the first surface, wherein an opening defined by the first surface and the cleaning portion extends along a lateral direction on the head.

In some embodiments, a toothbrush may comprise a base support and a first carrier. The base support may include a free end and an attachment end, and a first surface and a second surface. The first carrier may comprise a plurality of side walls. The plurality of side walls may form a cavity, wherein the cavity houses a first oral care agent. The first oral care agent may comprise an antibacterial composition.

DETAILED DESCRIPTION OF THE INVENTION

Definitions

The following text sets forth a broad description of numerous different embodiments of the present invention. The description is to be construed as exemplary only and does not describe every possible embodiment since describing every possible embodiment would be impractical, if not impossible, and it will be understood that any feature, characteristic, component, composition, ingredient, product, step or methodology described herein can be deleted, combined with or substituted for, in whole or part, any other feature, characteristic, component, composition, ingredient, product, step or methodology described herein. Numerous alternative embodiments could be implemented, using either current technology or technology developed after the filing date of this patent, which would still fall within the scope of the claims. All publications and patents cited herein are incorporated herein by reference.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). No term is intended to be essential to the present invention unless so stated. To the extent that any term recited in the claims at the end of this patent is referred to in this patent in a manner consistent with a single meaning, that is done for sake of clarity only so as to not confuse the reader, and it is not intended that such claim term be limited, by implication or otherwise, to that single meaning. Finally, unless a claim element is defined by reciting the word "means" and a function without the recital of any structure, it is not intended that the scope of any claim element be interpreted based on the application of 35 U.S.C. §112, sixth paragraph.

DESCRIPTION

For ease of explanation, the oral hygiene implement described hereafter shall be a manual toothbrush; however, an oral hygiene implement constructed in accordance with the present invention is not limited to a manual toothbrush construction and may be implemented in a refill for a power toothbrush. In addition, the device of the present invention may have a form of an oral applicator which can facilitate applying treatments to the oral cavity, to both hard and soft tissue.

Figure 1A:
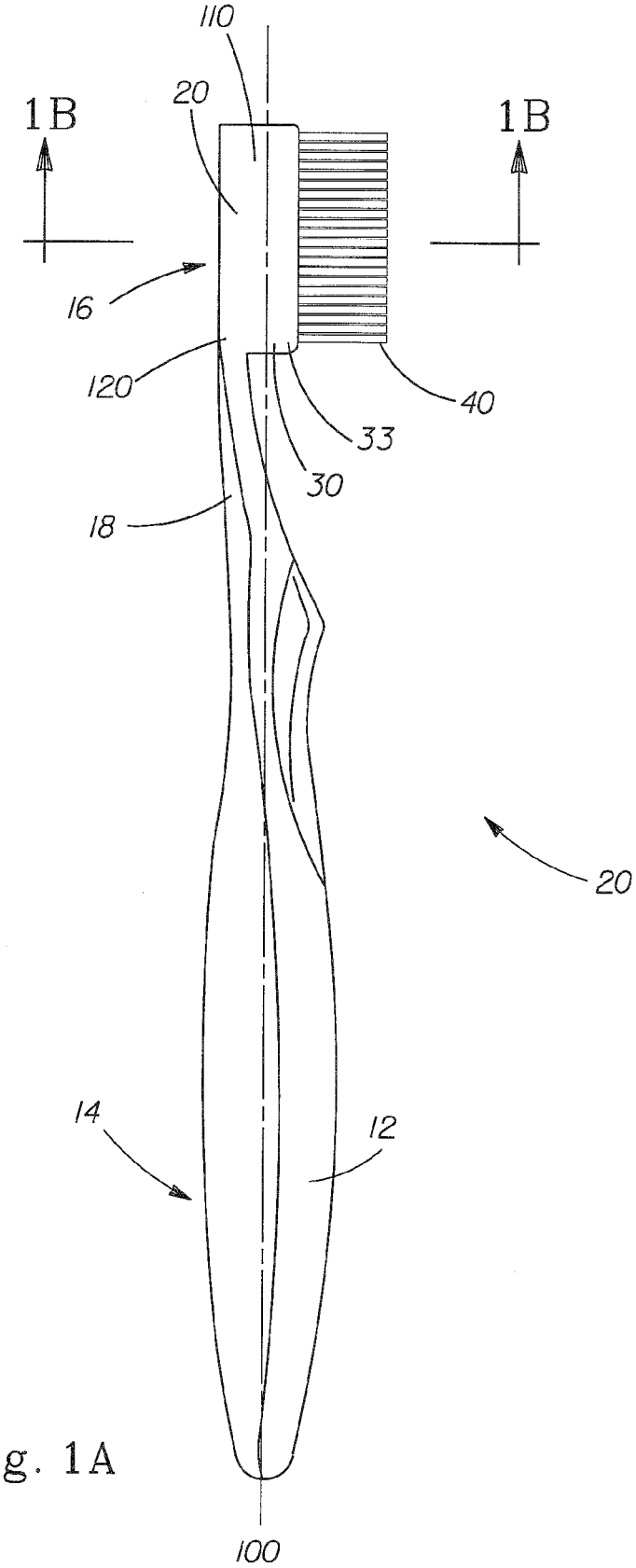
FIG. 1A shows a side view of a toothbrush constructed in accordance with the present invention.

As shown in FIG. 1A, in one embodiment, a toothbrush 10 comprises a handle 12, having a grip portion 14 and a cleaning portion 16. A neck 18 extends between the grip portion 14 and the cleaning portion 16. The cleaning portion 16 includes a base 20 and a carrier 30. The carrier 30 includes a support 33 and a plurality of cleaning elements 40. The base 20 further includes a free end 110 and an attached end 120 opposite the free end 110. The attached end 120 is attached to one end of the neck 18 while the grip portion 14 is attached to an opposite end of the neck 18.

Figure 1B:
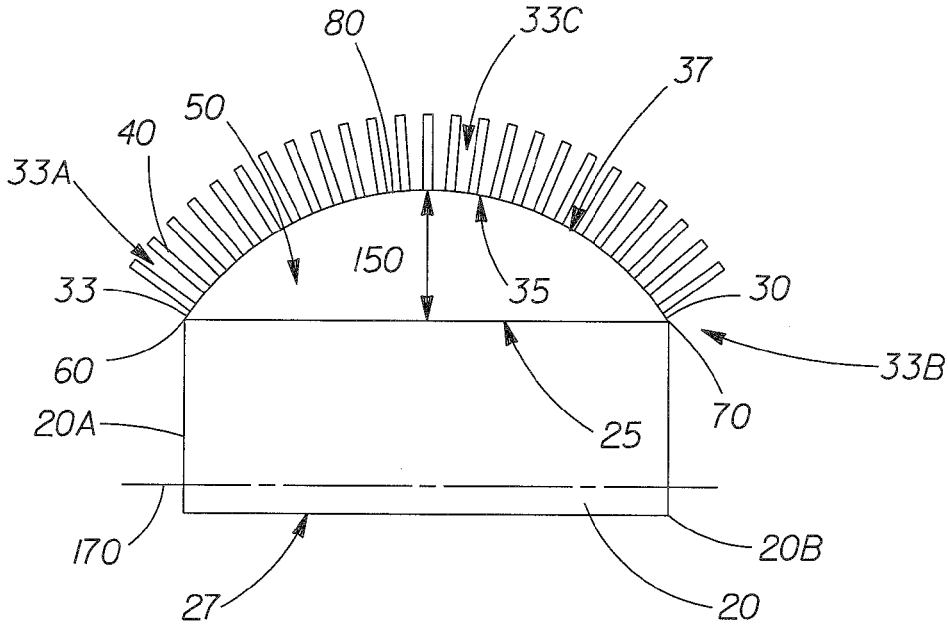
FIG. 1B shows a cross sectional view of the toothbrush of FIG. 1A taken from line 1B-1B.

As shown in FIG. 1B, the carrier 30 may comprise a first end 60 and a second end 70 which are attached to the base 20. A mid-section 80 of the carrier 30 may be elevated above the base 20 thereby creating cushioned area 50. As shown in FIG. 1A, the cushioned area 50 may extend along a longitudinal axis 100 of the toothbrush 10 and/or of the base 20. In some embodiments, the cushioned area 50 may extend along a lateral axis 170 as described with regard to FIG. 4.

Referring back to FIG. 1B, the carrier 30 may be attached to the base 20 such that the carrier 30 forms an arc when viewed from the free end 110 of the base 20. In some embodiments, the carrier 30 may be attached to the base 20 such that the carrier 30 forms a plurality of arcs. Any suitable shape may be formed by the carrier 30.

The cushioned area 50 may have a height 150. The height 150 of the cushioned area 50 is determined by measuring the maximum distance between a first surface 25 of the base 20 and a bottom surface 35 of the support 33. The height 150 of the cushioned area 50 is discussed in more detail hereafter.

The cushioned area 50 may allow the carrier 30 to flex, bend, move, or the like, with respect to the first surface 25 of the base 20 such that the carrier 30 may better accommodate the curvature of the teeth of a user. In order to achieve this flexibility, the carrier 30 may be constructed from a material which allows such flexibility. Any suitable material can be utilized. Some suitable examples of material from which the carrier 30 may be constructed include polyurethane, polyethylene, polypropylene, thermal plastic elastomer, silicone, nylon, polyester, the like, and/or combinations thereof.

In some specific embodiments, the carrier 30 may comprise cleaning elements 40 which include materials which would generally not be considered for use as a cleaning element in a toothbrush. For example, the cleaning elements may comprise a material having a Shore A hardness of greater than 80. Such materials are generally considered to be too hard for use as cleaning elements in a toothbrush.

The height 150 may be any suitable length. Some examples of suitable length include greater than about 1 mm, greater than about 2 mm, greater than about 3 mm, greater than about 4 mm, greater than about 5 mm, greater than about 6 mm, greater than about 7 mm, greater than about 8 mm, greater than about 9 mm, greater than about 10 mm, greater than about 11 mm, greater than about 12 mm, greater than about 13 mm, greater than about 14 mm, and/or less than about 15 mm, less than about 14 mm, less than about 15 mm, less than about 14 mm, less than about 13 mm, less than about 12 mm, less than about 11 mm, less than about 10 mm, less than about 9 mm, less than about 8 mm, less than about 7 mm, less than about 6 mm, less than about 5 mm, less than about 4 mm, less than about 3 mm, less than about 2 mm, or any individual number within the ranges described or any range described.

In some embodiments, the height 150 may be varied along the longitudinal axis 100 of the base 20 and/or toothbrush 10. For example, referring to both FIGS. 1A and 1B, adjacent the free end 110, the height 150 may be a first height and adjacent the attachment end 120, the height 150 may be a second height. In some embodiments, the second height may be less than the first height. This may provide facilitated access by the user to the teeth located in the back of the oral cavity. Embodiments are contemplated where the second height is greater than the first height.

In some embodiments, the height 150 may be constant in a particular area of the cleaning portion 16. For example, adjacent the free end 110, the height 150 may be a first height. This height may be realized in the carrier 30 along about 10 percent of overall longitudinal length of the carrier 30. In some embodiments, the height 150 may be constant through greater than about 1 percent, greater than about 5 percent, greater than about 10 percent, greater than about 15 percent, greater than about 25 percent, greater than about 30 percent, greater than about 35 percent, greater than about 40 percent, greater than about 45 percent, greater than about 50 percent, greater than about 55 percent, greater than about 60 percent, greater than about 65 percent, greater than about 70 percent, greater than about 75 percent, and/or less than about 75 percent, less than about 70 percent, less than about 65 percent, less than about 60 percent, less than about 55 percent, less than about 50 percent, less than about 45 percent, less than about 40 percent, less than about 35 percent, less than about 30 percent, less than about 25 percent, less than about 20 percent, less than about 15 percent, less than about 10 percent, or any individual number within these ranges. In such embodiments, the height 150 adjacent the attached end 120 may be less than that of the carrier 30 adjacent the free end 110. Additionally, in such embodiments, the height 150 adjacent the attached end 120 may be constant, may decrease gradually toward the attached end 120, may increase gradually toward the attached end 120, or combinations thereof.

As stated previously the carrier 30 includes a plurality of cleaning elements 40. The cleaning elements 40 may be attached to the support 33 in any suitable fashion. For example, the cleaning elements 40 may be integral with the support 33 such that the support 33 and the cleaning elements 40 are injection molded, created, fabricated, machined, and/or the like, as one piece. As yet another example, the cleaning elements 40 may be inserted into openings through the support 33. Other examples include flocked, woven, thermally bonded, stamped, the like, or combinations thereof.

The cleaning elements 40 may extend from a large portion of an outer surface 37 of the support 33. For example, cleaning elements 40 may extend from the support 33 adjacent the first end 60 and/or the second end 70 of the support 33. In other embodiments, the cleaning elements 40 may be spaced from the first end 60 and/or the second end 70.

The cleaning elements 40 may have any suitable shape. Referring back to FIG. 1B, for example, the cleaning elements 40 in zones 33A and 33B may comprise a flattened shape to assist in interdental cleaning functions, while the cleaning elements 40 in zone 33C may comprise a more rounded shape. The cleaning elements 40 may be disposed at any suitable angle with respect to the support 33. For example, the cleaning elements 40 may be disposed radially. In other embodiments, the cleaning elements 40 may be disposed at an angle with respect to the lateral axis 170. Some examples of suitable angles include greater than about 0 degrees, greater than about 10 degrees, greater than about 20 degrees, greater than about 30 degrees, greater than about 40 degrees, greater than about 50 degrees, greater than about 60 degrees, greater than about 70 degrees, greater than about 80 degrees, and/or less than about 90 degrees, less than about 80 degrees, less than about 70 degrees, less than about 60 degrees, less than about 50 degrees, less than about 40 degrees, less than about 30 degrees, less than about 20 degrees, less than about 10 degrees, or any individual number within the ranges described, or any range including the values described.

The cleaning elements 40 may have any suitable length. Some examples of suitable length include greater than about 2 mm, greater than about 2.5 mm, greater than about 3 mm, greater than about 3.5 mm, greater than about 4.0 mm, greater than about 4.5 mm, greater than about 5.0 mm, greater than about 5.5 mm, greater than about 6.0 mm, greater than about 6.5 mm, greater than about 7.0 mm, greater than about 7.5 mm, greater than about 8.0 mm, greater than about 8.5 mm, and/or less than about 8.5 mm, less than about 8.0 mm, less than about 7.5 mm, less than about 7.0 mm, less than about 6.5 mm, less than about 6.0 mm, less than about 5.5 mm, less than about 5.0 mm, less than about 4.5 mm, less than about 4.0 mm, or less than about 3.5 mm, less than about 3 mm, less than about 2.5 mm, less than about 2 mm, or any individual number within the ranges specified.

In some embodiments, the cleaning elements 40 adjacent the free end 110 may have a height which is greater than the height of the cleaning elements 40 adjacent the attached end 120. This may provide better cleaning of the teeth in the back of the oral cavity. Additionally, the cleaning elements 40 in zones 33A and 33B may have a length which is greater than those of zone 33C. This feature may provide better interdental cleaning by the cleaning elements 40.

Referring still to FIG. 1B, the base 20 has sides 20A and 20B. The sides extend between the first surface 25 and a second surface 27 opposite the first surface 25. The first end 60 and the second end 70 of the carrier 30 may be attached to the first surface 25 or may be attached to at least one of the sides 20A and 20B. In some embodiments, the carrier 30 may extend through the base 20 from the first surface 25 to the second surface 27. Such embodiments are discussed hereafter with regard to FIGS. 5A, 5B, and 6.

Figure 12A:
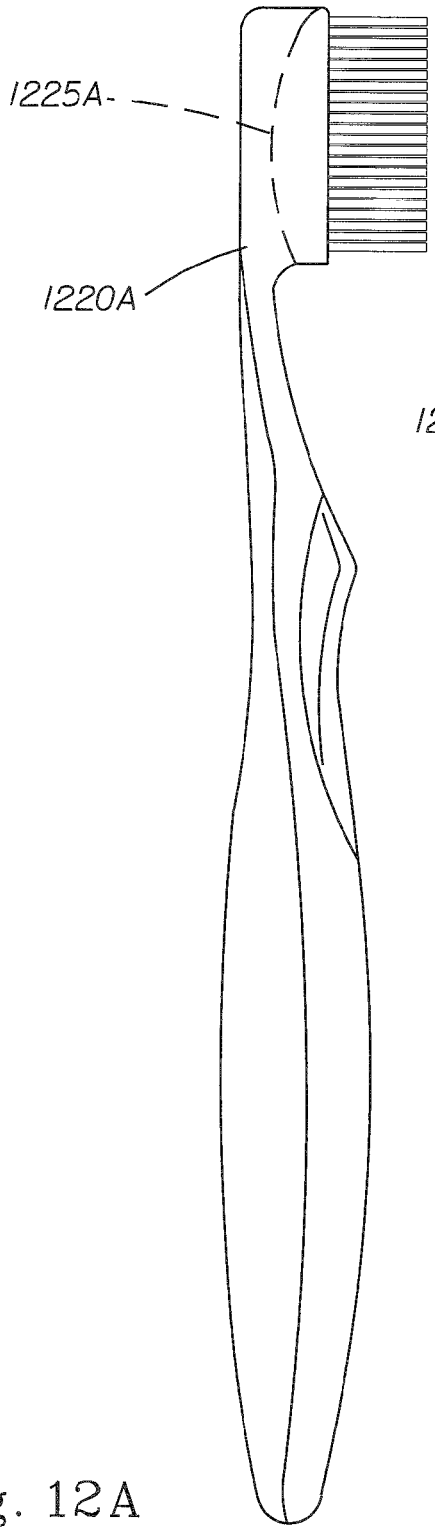
FIG. 12A shows a side view of a toothbrush of another embodiment of the present invention.
Figure 12B:
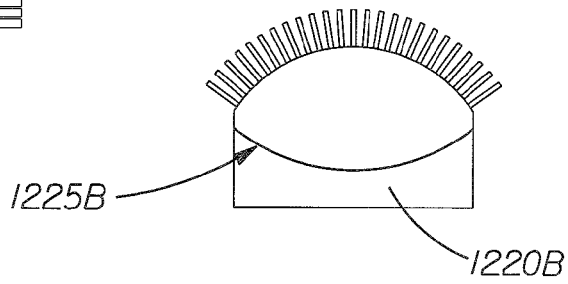
FIG. 12B shows a cross sectional view of a toothbrush of another embodiment of the present invention.

Referring to FIGS. 12A and 12B, in some embodiments, a base 1220A may comprise a concave first surface 1225A. As shown, the concavity of the concave first surface 1225A may extend along a longitudinal direction of the brush. In some embodiments, a base 1220B may comprise a concave first surface 1225B which includes a concavity which extends along a lateral direction of the base 1220B. In other embodiments, a brush constructed in accordance with the present invention may comprise a first surface which includes concavities which extend along both a longitudinal and lateral direction.

Figure 13A:
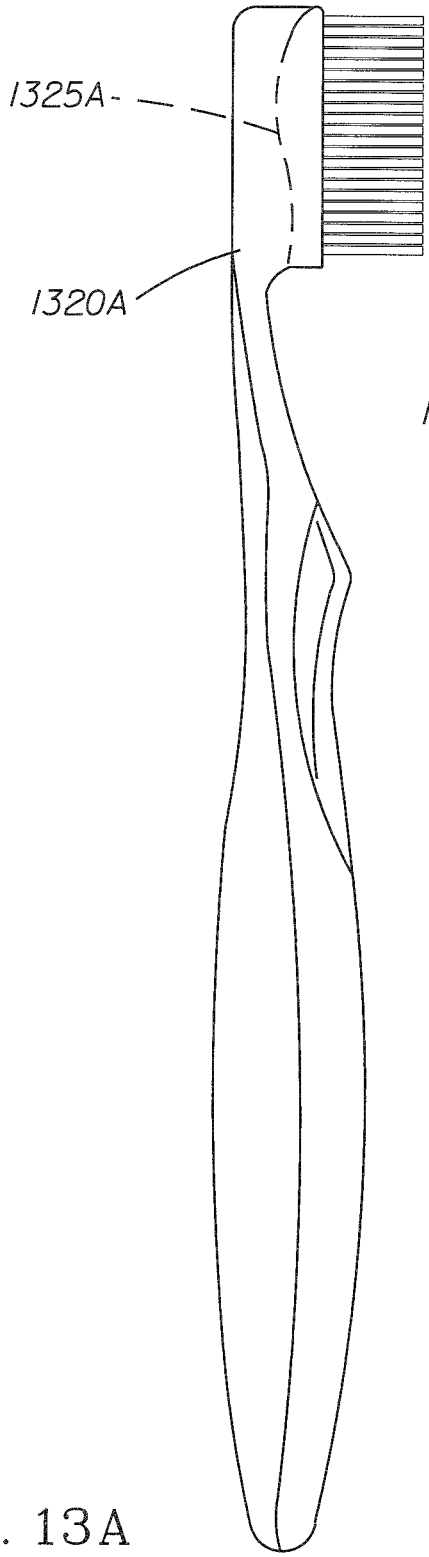
FIG. 13A shows a side view of a toothbrush of another embodiment of the present invention.
Figure 13B:
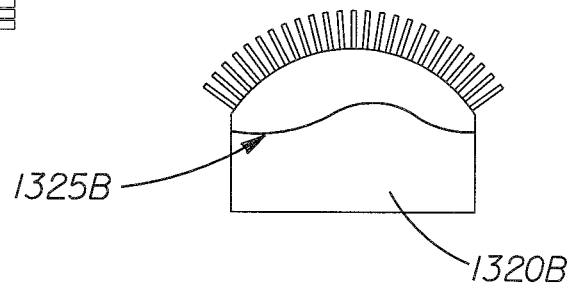
FIG. 13B shows a cross sectional view of a toothbrush of another embodiment of the present invention.

Referring to FIGS. 13A and 13B, in some embodiments, a base 1320A may comprise a convex first surface 1325A where the convexity extends along a longitudinal direction of the brush. In some embodiments, a base 1320B may comprise convex first surface 1325B where the convexity extends along a lateral direction. In other embodiments, a brush constructed in accordance with the present invention may comprise a first surface which includes convexities which extend along both a longitudinal direction and the lateral direction.

Figure 14A:
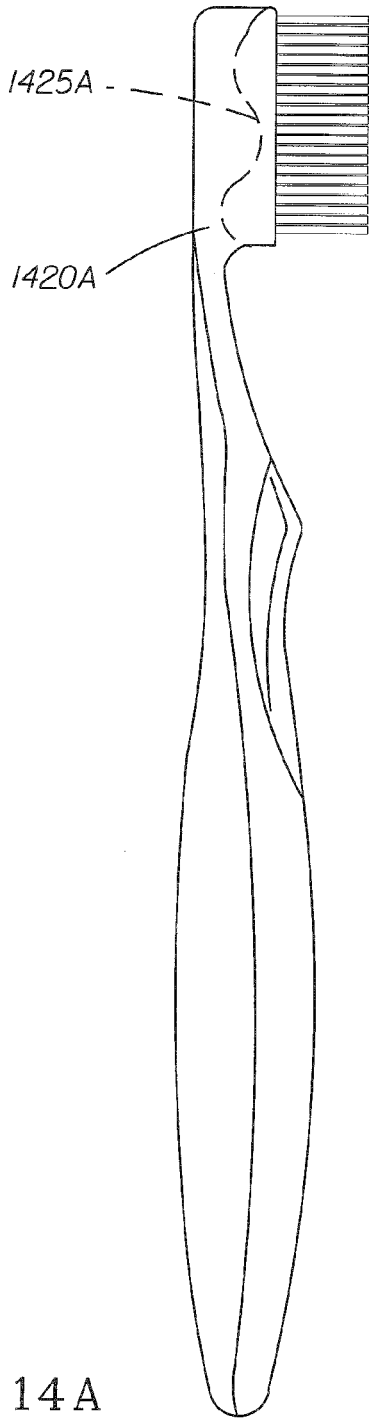
FIG. 14A shows a side view of a toothbrush of another embodiment of the present invention.
Figure 14B:
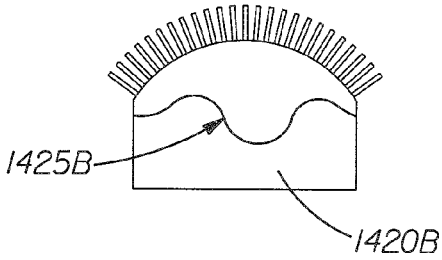
FIG. 14B shows a cross sectional view of a toothbrush of another embodiment of the present invention.

Referring to FIGS. 14A and 14B, in some embodiments, a base 1420A may comprise a first surface 1425A which includes concavities and/or convexities. Similarly, when viewing a cross section of a brush, in some embodiments, a base 1420B may comprise a first surface 1425B which includes concavities and/or convexities along a lateral direction. In other embodiments, a brush constructed in accordance with the present invention may comprise concavities and/or convexities which are in the longitudinal and/or lateral direction.

Without wishing to be bound by theory, it is believed that during brushing, the support, as described herein, may compress against the first surface providing enhanced contact of broad surfaces. When the first surface is concave it is believed that the compression of the support helps to guide elements between the teeth of a user. And, the compression may also help guide the cleaning elements in surrounding the teeth. When the first surface is convex, the compression of the support against the first surface may cause a ripple effect when the cleaning elements are applied to the hard and soft tissue of the oral cavity. It is believed that this provides improved interdental cleaning and improved soft tissue stimulation. When the first surface includes a combination of concavities and/or convexities, it is believed that both the benefits of the concave first surface and the convex surface may be able to be realized.

Figure 1C:
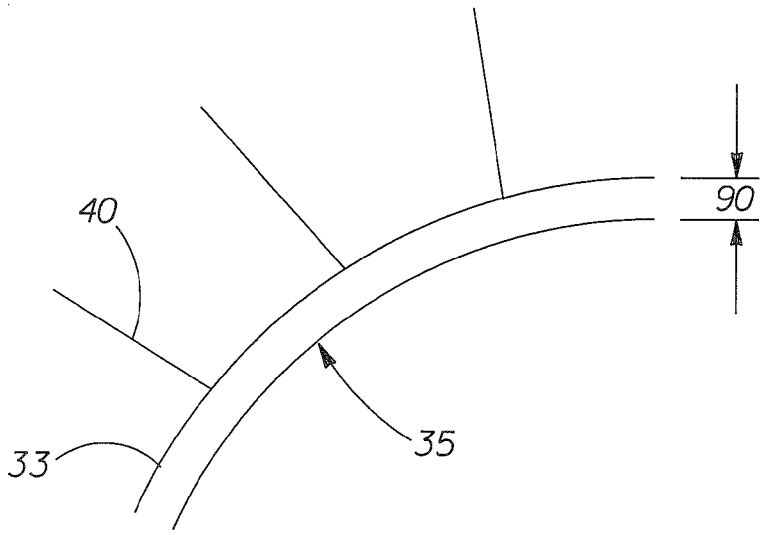
FIG. 1C shows a close up view of the cross section of a support shown in FIG. 1B.

Referring to FIG. 1C, the support 33 may have a thickness 90 which may be configured to provide the flexing, bending, moving of the carrier 30. Some examples of suitable thicknesses include from about 0.1 mm to about 3 mm. In some embodiments, the thickness 90 may be greater than about 0.1 mm, greater than about 0.2 mm, greater than about 0.3 mm, greater than about 0.4 mm, greater than about 0.5 mm, greater than about 0.6 mm, greater than about 0.7 mm, greater than about 1.0 mm, greater than about 1.25 mm, greater than about 1.50 mm, greater than about 1.75 mm, greater than about 2.0 mm, greater than about 2.25 mm, greater than about 2.50 mm, greater than about 2.75 mm, greater than about 3.0 mm, and/or less than about 3.0 mm, less than about 2.75 mm, less than about 2.50 mm, less than about 2.25 mm, less than about 2.0 mm, less than about 1.75 mm, less than about 1.50 mm, less than about 1.25 mm, less than about 1.0 mm, less than about 0.9 mm, less than about 0.8 mm, less than about 0.7 mm, less than about 0.6 mm, less than about 0.5 mm, less than about 0.4 mm, less than about 0.3 mm, less than about 0.2 mm, or any individual number or any ranges within the values listed.

Referring to FIGS. 1A and 1C, in some embodiments, the support 33 may have a thickness 90 which varies along the longitudinal axis 100 of the base 20 and/or toothbrush 10. For example, the support 33 may have a first thickness near the free end 110 of the cleaning portion 16 and a second thickness near the attachment end 120 of the cleaning portion 16. In some embodiments, the first thickness may be greater than the second thickness. In such embodiments, a portion of the carrier 30 near the free end 110 can be stiffer than another portion of the carrier 30 which is near the attachment end 120. The benefit for this is that the stiffer portion adjacent the free end 110 of the support 33 provides an improved cleaning element especially for the back teeth, whereas the less stiff portion adjacent the attachment end 120 would be more flexible providing better interproximal access and soft tissue massaging. In general, varying thickness provides selective support and consequently additional control of element motion. Embodiments are contemplated where the second thickness is greater than the first thickness.

Referring to FIGS. 1B and 1C, in some embodiments, the support 33 may have a thickness 90 which varies along a lateral axis 170. For example, the support 33 may comprise various zones of thickness, e.g. 33A, 33B, and 33C. Zone 33A, adjacent the first end 60 of the carrier 30 may comprise a first thickness; zone 33B, adjacent the second end 70 may comprise a second thickness, while zone 33C, which includes the mid-section 80 may comprise a third thickness. In some embodiments, the first thickness and the second thickness may be equal and be less than the third thickness. As zones 33A and 33B are disposed outboard of zone 33C, zones 33A and 33B are more likely to interact with the gumline during use. As such, a thinner support 33 in zone 33A and 33B may allow for more comfort to the user during use. Embodiments are contemplated where zone 33A and/or zone 33B includes a thicker support 33 than that of zone 33C. Additionally, embodiments are contemplated where they support 33 has a thickness which varies both along the lateral axis and the longitudinal axis.

Figure 2:
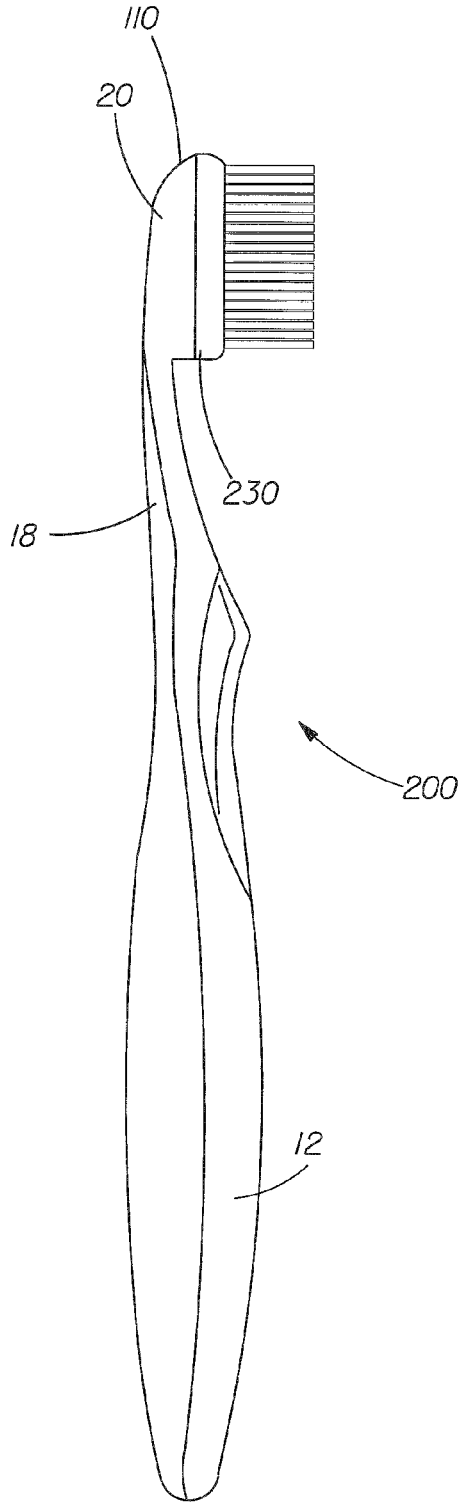
FIG. 2 shows a side view of a toothbrush of another embodiment of the present invention.

As shown in FIG. 2, a toothbrush 200 may comprise a carrier 230 which is configured to cover the free end 110 of the base 20. Such embodiments may provide some additional comfort to users with regard to the protection of the gums. Additional embodiments are contemplated where the free end 110 of the base 20 is covered by an element which is not the carrier 230. For example, a separate elastomer element may be positioned to cover at least part of or all of the free end 110 of the base 20. As yet another example, a separate elastomer element may be positioned to cover at least a portion or all of (1) the free end 110; (2) side 20A (shown in FIG. 1B) of base 20; and/or (3) side 20B (shown in FIG. 1B) of base 20.

The carrier 230 may be configured to provide a cushioned area 50 having height 150 as described previously.

Figure 3:
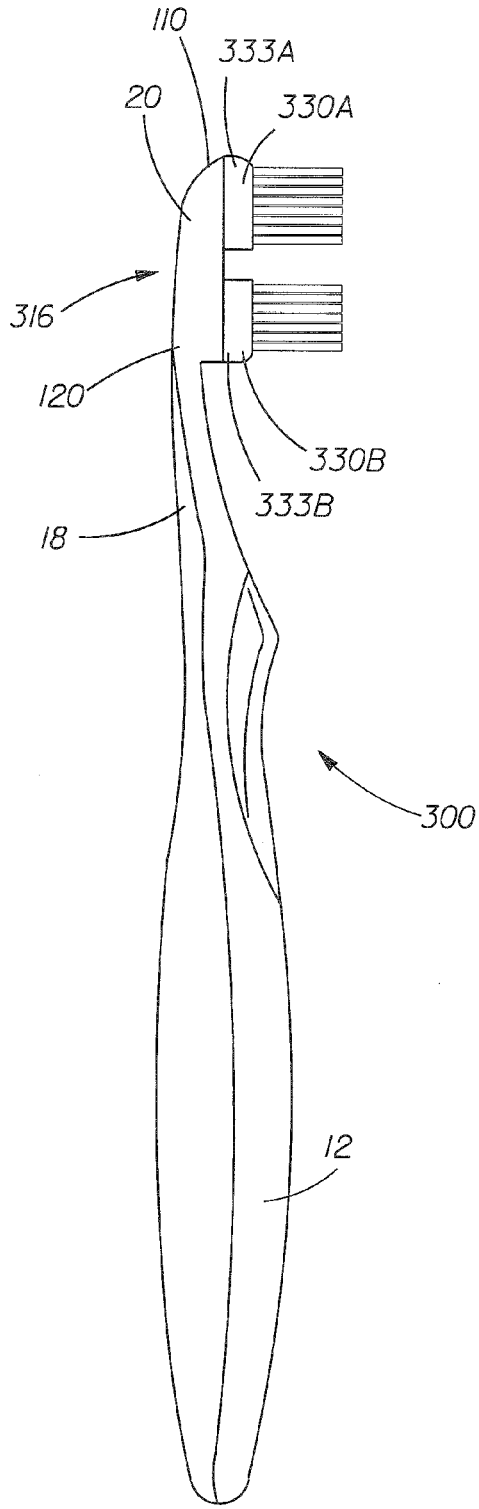
FIG. 3 shows a side view of a toothbrush of another embodiment of the present invention.

As shown in FIG. 3, a toothbrush 300 constructed in accordance with the present invention may comprise a cleaning portion 316 which includes a plurality of carriers 330A and 330B. The carriers 330A and 330B may be configured as described above with regard to the carrier 30 (shown in FIGS. 1A-1C). For example, the carrier 330A may comprise a support 333A and the carrier 330B may comprise a support 333B. In some embodiments, the thickness of the support 333A may be thicker than the thickness of the support 333B. In some embodiments, the support 333A may have a thickness which decreases from the free end 110 toward the attached end 120. Similarly the support 333B may have a thickness which decreases toward the attachment end 120. Alternatively, the support 333A and/or the support 333B may have thicknesses which are constant. The thicknesses of the supports 333A and 333B can be as described heretofore with regard to the thickness 90 (shown in FIG. 1C) of the support 33 (shown in FIGS. 1A through 1C).

The carriers 330A and 330B may be configured to provide a cushioned area similar to that described previously with regard to the cushioned area 50 of FIG. 1B. However, embodiments are contemplated where the first carrier 330A provides a cushioned area having a greater height than that of the second carrier 330B. This configuration may provide the user with improved access to teeth located in the back of the oral cavity.

Figure 4:
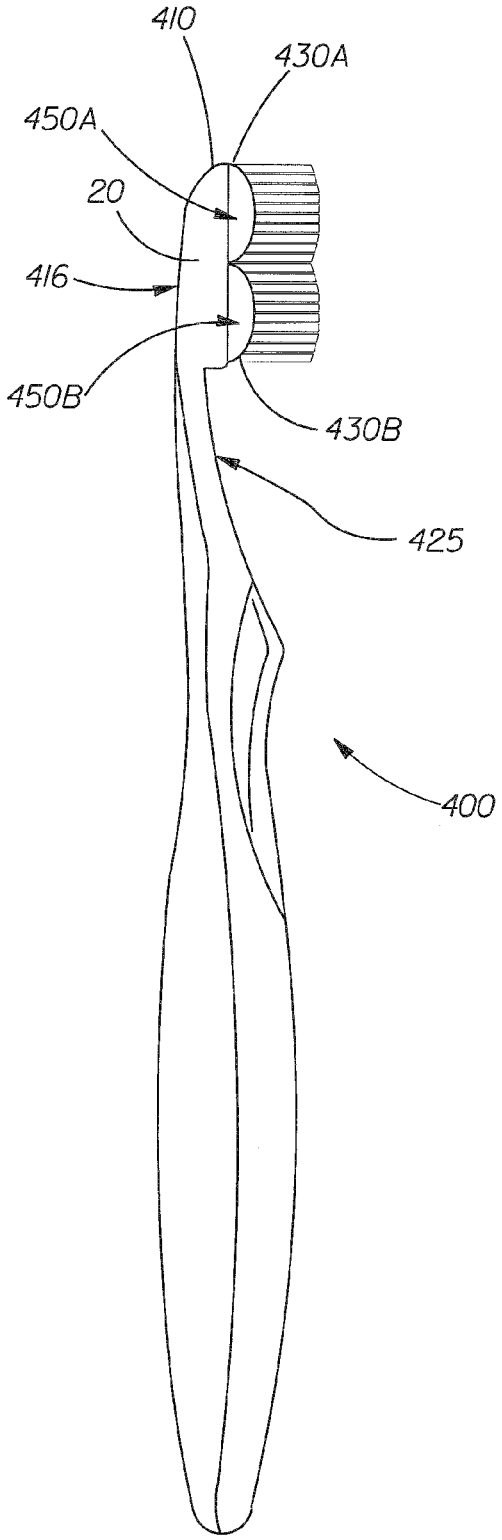
FIG. 4 shows a side view of a toothbrush of another embodiment of the present invention.

As shown in FIG. 4, a toothbrush 400 constructed in accordance with the present invention may comprise a cleaning portion 416 having a plurality of carriers 430A and 430B. In some embodiments, carriers 430A and 430B may be configured such that a plurality of cushioned areas 450A and 450B extending in a transverse direction are created. The carriers 430A and 430B may comprise a plurality of cleaning elements 40 as described heretofore. Additionally, the cushioned areas 450A and 450B may be configured similar to the cushioned area 50 (shown in FIG. 1B) described heretofore and may include a height as described heretofore with regard to the height 150. As shown, the first carrier 430A may be attached to the free end 410 of a cleaning portion 416 or may be attached to a first surface 425 of the base 20 of the cleaning portion 416.

Embodiments are contemplated where a toothbrush constructed in accordance with the present invention comprises a carrier having a cushioned area extending generally parallel to a longitudinal axis, and a carrier having a cushioned area extending generally parallel to a lateral axis. For example, a toothbrush constructed in accordance with the present invention may comprise first carrier adjacent a free end of the brush. The first carrier may include a cushioned area which extends generally parallel to a longitudinal axis. The brush may further include a second carrier adjacent an attachment end. The second carrier may include a cushioned area which extends generally parallel to a lateral axis or vice versa.

Although not shown, the carriers 430A and 430B may comprise an opening in their respective supports. The openings may be configured in any suitable manner. For example, the opening may comprise a serpentine split. However, any suitable shape may be utilized.

Figure 5A:
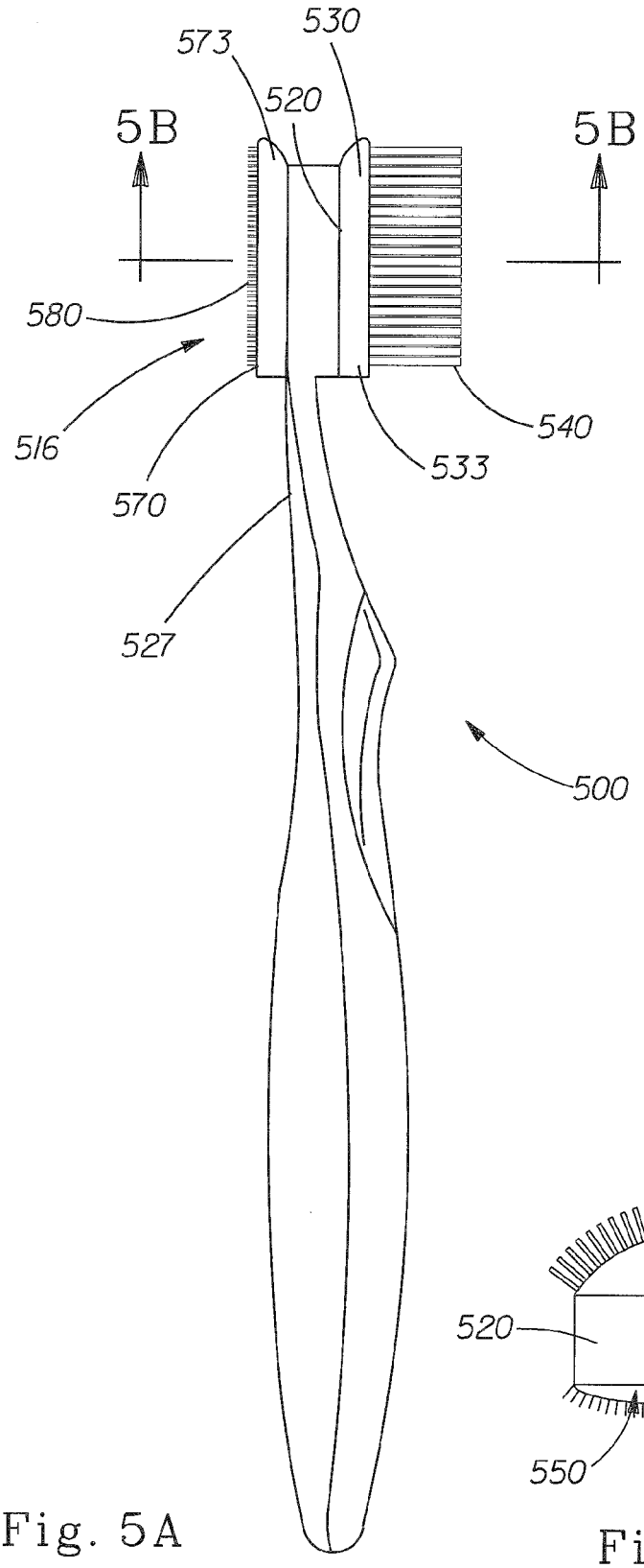
FIG. 5A shows a side view of a toothbrush of another embodiment of the present invention.

As shown in FIG. 5A, in another embodiment, a toothbrush 500 constructed in accordance with the present invention may comprise a cleaning portion 516 having a carrier 530 and a soft tissue cleanser 570. The carrier 530 may comprise a support 533 and a plurality of cleaning elements 540 as described heretofore. The carrier 530 may be configured in any suitable manner including those described with regard to FIGS. 1A-1C and FIGS. 2-4.

Figure 5B:
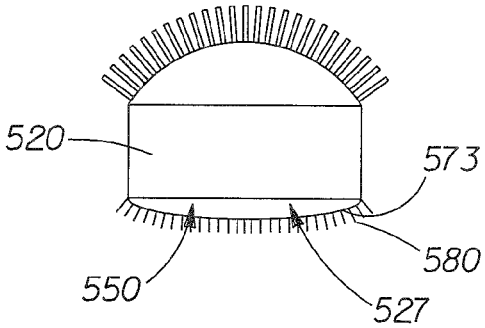
FIG. 5B shows a cross sectional view of the toothbrush of FIG. 5A along line 5B-5B

The soft tissue cleanser 570 may similarly comprise a support 573 and a plurality of cleaning elements 580. The cleaning elements 580 may be configured similarly to the cleaning elements 40 described previously. Additionally, as shown in FIG. 5B, the soft tissue cleanser 570 may be configured such that a cushioned area 550 is created between the support 573 and a second surface 527 of a base 520. The cushioned area 550 may be configured similarly to the cushioned area 50 discussed herein, and the cushioned area 550 may include a height which can be similar to that discussed herein with regard to the height 150.

In some embodiments, the soft tissue cleanser 570 may comprise a height which is less than a height of the carrier 530. In some embodiments, the soft tissue cleanser may comprise a height which is greater than the height of the carrier 530. Yet in other embodiments, the soft tissue cleanser may comprise a height which is equal to that of the carrier 530.

In order to reduce the gag reflex of the user, embodiments, are contemplated where the soft tissue cleanser 570 and/or the carrier 530 near a free end of the base 520 comprise a lower height than portions of the soft tissue cleanser 570 and/or the carrier 530 which are adjacent an attachment end of the base 520.

In some embodiments, the carrier 530 may be attached to the base 520 independently of the soft tissue cleanser 570. In other embodiments, the base 520 may comprise opening therethrough. The carrier 530 and the soft tissue cleanser 570 in such embodiments may be attached to one another. Additionally, in these embodiments, the carrier 530 may be integrally formed with the soft tissue cleanser 570. In these embodiments, the carrier 530 and the soft tissue cleanser 570 may be injection molded, created, fabricated, machined, and/or the like, as one piece. Such construction can help fix both the carrier 530 and the soft tissue cleanser 570 to the base 520.

As shown, the cushioned areas of both the carrier 530 and the soft tissue cleanser 570 may extend generally parallel to a longitudinal axis of the toothbrush 500 and/or base 520. However, embodiments, are contemplated where the cushioned area of at least one of the carrier 530 and/or the soft tissue cleanser 570 extends generally parallel to the longitudinal axis, while the other extends generally parallel to a lateral axis.

Figure 6:
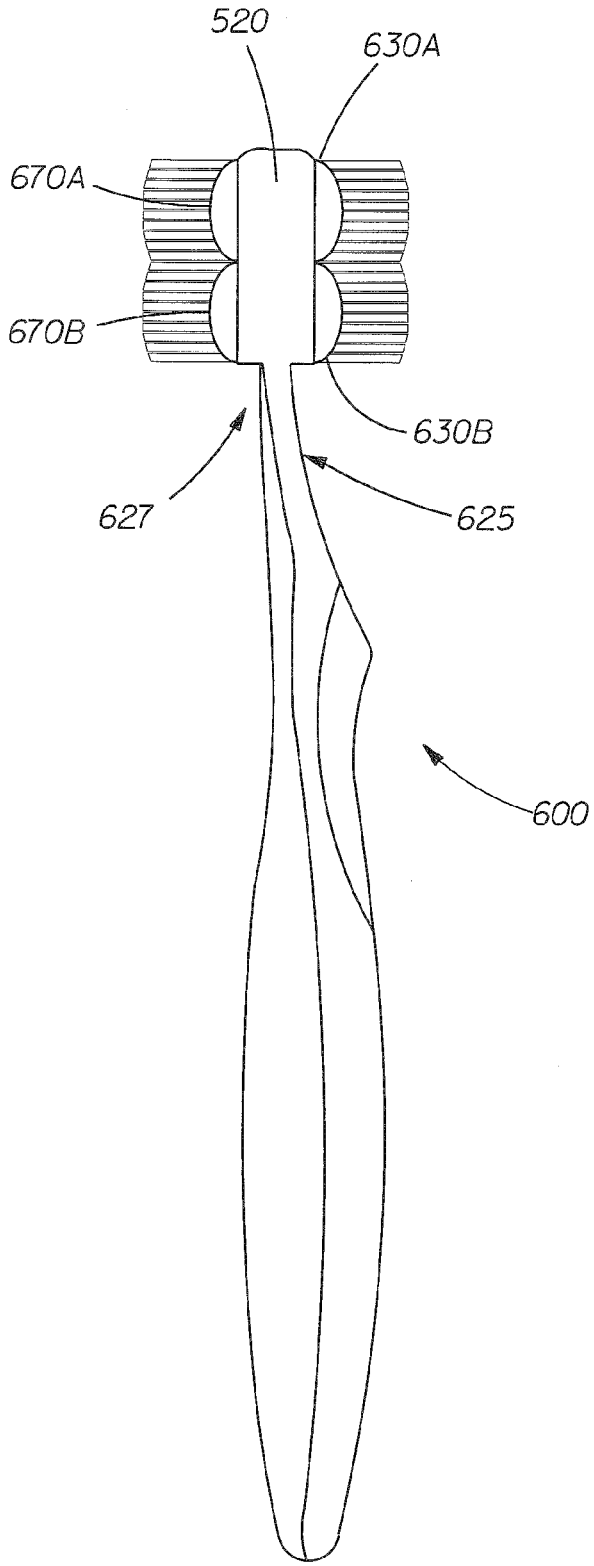
FIG. 6 shows a side view of a toothbrush of another embodiment of the present invention.

As shown in FIG. 6, a toothbrush 600 constructed in accordance with the present invention may comprise a plurality of carriers 630A and 630B on a first surface 625 and may comprise a plurality of soft tissue cleansers 670A and 670B on a second surface 627. As shown, the carriers 630A, 630B, and/or the soft tissues cleansers 670A and 670B, may be configured such that there respective cushioned areas extend in a direction generally parallel with a lateral axis. However, embodiments are contemplated where at least one of the carriers 630A, 630B, and/or at least one of the soft tissue cleansers 670A, 670B has a cushioned area which extends generally parallel to a longitudinal axis, and at least one of the carriers 630A, 630B, and/or at least one of the soft tissue cleansers 670A, 670B has a cushioned area which extends generally parallel to a lateral axis. Additionally, embodiments are contemplated wherein a toothbrush in accordance with the present invention comprises either a single carrier on the first surface 625 or a single soft tissue cleanser on the second surface 627.

Figure 15:
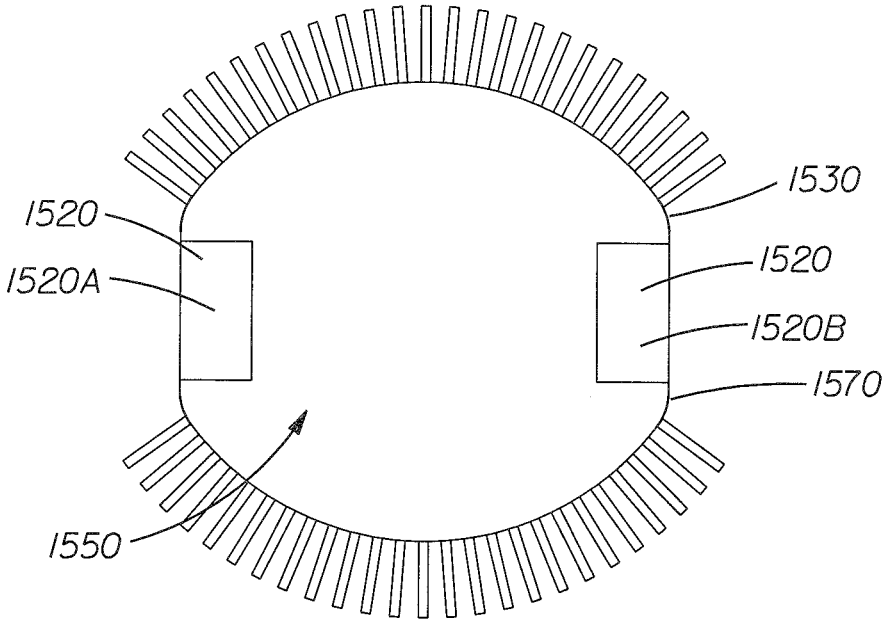
FIG. 15 shows a cross sectional view of an oral care implement constructed in accordance with the present invention.

As shown in FIG. 15, embodiments are contemplated where a base 1520 includes a plurality of arms 1520A and 1520B. Arms 1520A and 1520B may be laterally spaced apart such that a cushioned area 1550 is bounded by a carrier 1530 and a soft tissue cleanser 1570. This type of oral care implement may provide the benefit of allowing the carriers 1530 and the soft tissue cleanser 1570 to substantially conform to the geometry of hard and soft tissue in the oral cavity, particularly in the fully engaged (compressed) condition. As an example, this could allow the carrier 1530 and the soft tissue cleanser 1570 to simultaneously wrap around multiple tooth surfaces without interference from striking a base.

Figure 7A:
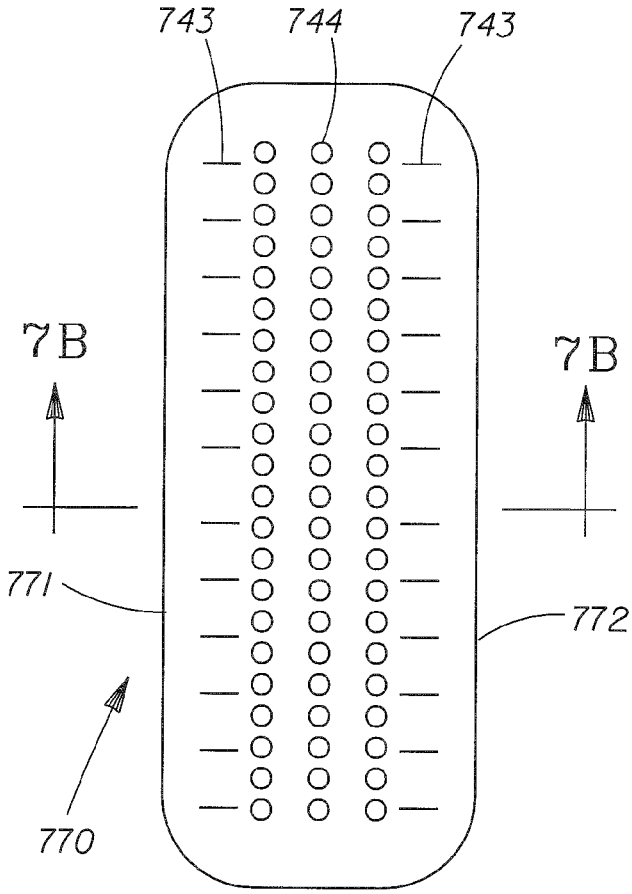
FIG. 7A shows a plan view of a soft tissue cleanser constructed in accordance with the present invention.

Soft tissue cleansers constructed in accordance with the present invention may comprise any suitable cleaning elements. For example, as shown in FIG. 7A, a soft tissue cleanser 770 may comprise wiping elements 743 and round elements 744. The wiping elements 743 may be disposed adjacent a first edge 771 and a second edge 772. The wiping elements 743 can help scrape the broad surfaces of the tongue while the round elements 744 can access the finer structure of the tongue.

Figure 7B:
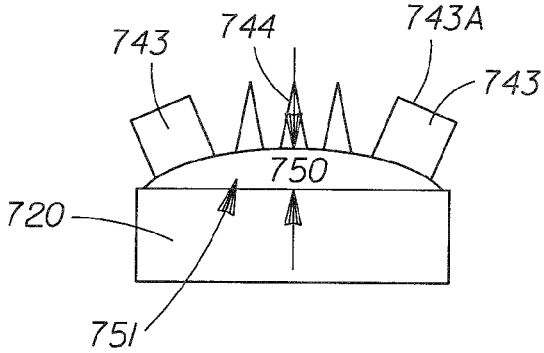
FIG. 7B shows a cross sectional view of the soft tissue cleanser of FIG. 7A along line 7B-7B.

As shown in FIG. 7B, the soft tissue cleanser 770 may be configured such that in use, a height 750 of a cushioned area 751 may decrease with respect to a base 720. When the height 750 decreases a top edge 743A of the wiping elements 743 can move laterally inward toward the round elements 744. This movement can provide the user with a soft tissue cleanser having tightly packed cleaning elements which may provide more efficacious cleaning of the soft tissues within the oral cavity.

Figure 8A:
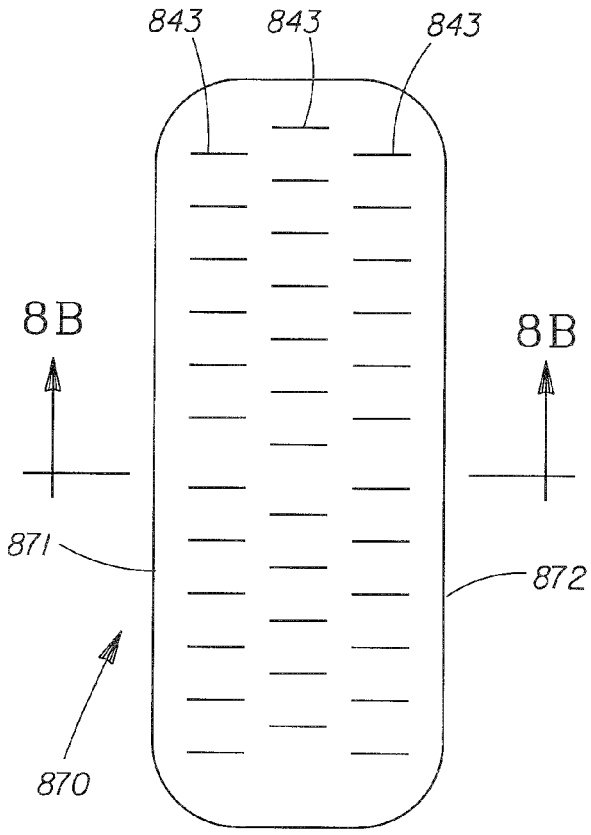
FIG. 8A shows a plan view of a soft tissue cleanser of another embodiment of the present invention.
Figure 8B:
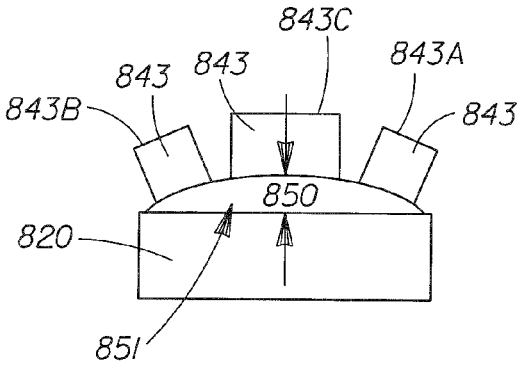
FIG. 8B shows a cross sectional view of the soft tissue cleanser of FIG. 8A along line 8B-8B, the soft tissue cleanser being shown in the uncompressed state.
Figure 8C:
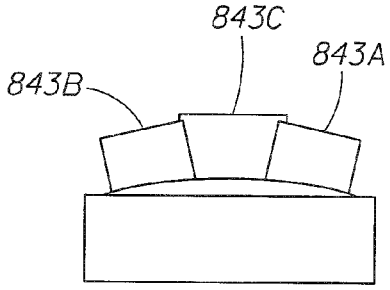
FIG. 8C shows a cross sectional view of the soft tissue cleanser of FIG. 8A along line 8B-8B, the soft tissue cleanser being shown in the compressed state.

In another embodiment, as shown in FIGS. 8A through 8C, a soft tissue cleanser 870 constructed in accordance with the present invention may comprise wiping elements 843 adjacent a first edge 871 and adjacent a second edge 872. Additionally, the soft tissue cleanser 870 may comprise wiping elements 843 between those wiping elements 843 adjacent the first edge 871 and the second edge 872. The soft tissue cleanser 870 may be configured such that when not in use, a cushioned area 851 is formed between the soft tissue cleanser 870 and a base 820. A height 850 between the soft tissue cleanser 870 and the base 820 may be as described previously with regard to the height 150 (shown in FIG. 1B). In use the height 850 may decrease due to the application of force by the user on the soft tissue cleanser 870 against soft tissue. The decrease in height 850 may cause top edges 843A and 843B to move laterally inward such that the top edges 843A, 843B, and 843C form a substantially continuous edge.

Figure 9:
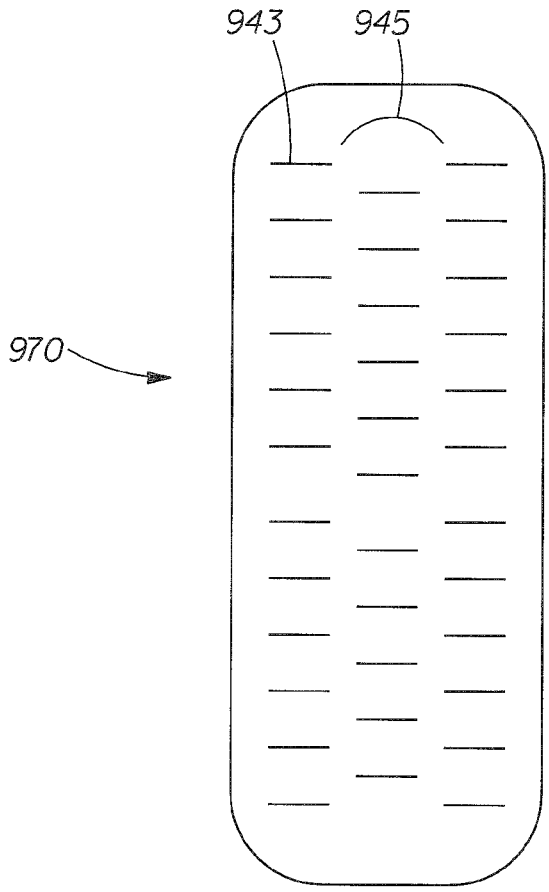
FIG. 9 shows a plan view of a soft tissue cleanser of another embodiment of the present invention.

In other embodiments, referring to FIG. 9, a soft tissue cleanser 970 constructed in accordance with the present invention may comprise wiping elements 943 as well as arcuate elements 945. The arcuate elements 945 may be disposed in any suitable location. As shown, the arcuate element 945 is disposed adjacent an end 910 of the soft tissue cleanser 970. The end 910 of the soft tissue cleanser 970 may correspond to the free end discussed heretofore.

Soft tissue cleansers of the present invention may comprise any suitable combination of wiping elements, arcuate elements, and/or rounded elements. These elements may be arranged in any suitable manner in order to provide efficacious cleaning of soft tissue within the oral cavity. These elements may also be designed to promote soft tissue stimulation and massage.

It is believed that by including a cushioned area in the soft tissue cleanser, generally harder materials may be utilized for the soft tissue cleanser. For example, it is known in the art to use thermoplastic elastomers for soft tissue cleansers. These thermoplastic elastomers generally have a Shore A hardness of between 20 and 80. In contrast, the soft tissue cleansers of the present invention may comprise a thermoplastic which has a Shore A hardness greater than 80 to provide better cleaning and stimulation, and still provide a softer feel to the user because of the cushioned area.

Figure 10:
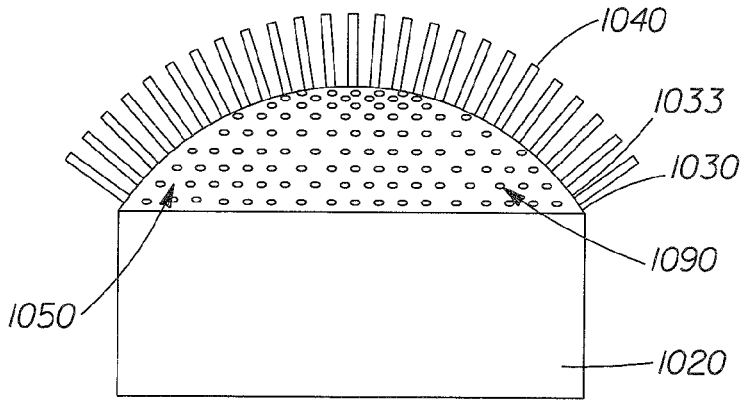
FIG. 10 shows a cross sectional view of a toothbrush constructed in accordance with the present invention, the toothbrush having the additional benefit of a releasable material.

The cushioned area of either the carriers described herein or the soft tissue cleansers described herein can provide the user with additional advantages. For example, as shown in FIG. 10, a carrier 1030 comprising a support 1033 and cleaning elements 1040 may be attached to a base 1020 such that a cushioned area 1050 is created. The cushioned area 1050 may comprise a releasable material 1090 which can provide additional benefits to the user. For example, the support 1033 may comprise an opening or a plurality of openings therein which allow the releasable material 1090 to be released into the oral cavity during use.

The releasable material 1090 may be any suitable substance. For example, the releasable material 1090 may comprise any suitable biocompatible medication or chemical for oral use. The releasable material 1090 can be provided in a suitable shape in a tablet form for oral use or any other suitable form. The releasable material 1090 may be released to the inside of the mouth, lips, or cheeks by way of several methods, including but not limited to abrasion, a temperature change, a change in pH or dissolution.

In some embodiments, the releasable material 1090 may comprise a soluble breath freshening agent which dissolves in an oral fluid, such as salvia. In particular, the breath freshening agent may be an anti-bacterial substance used to treat anaerobic flora and bacteria residing on the tongue or other soft tissues of the mouth. One preferred example of a breath freshening agent which may be used is triclosan. In some embodiments, the releasable material 1090 may comprise a dentifrice, gel, mouthrinse, plaque indication substances, the like, and/or combinations thereof.

In other embodiments, the releasable material 1090 can comprise a chemical substance which imparts other benefits. For example, a chemical substance (e.g., a sensate) can be used to provide a biochemical sensory response to the inside tissue of the mouth and/or lips of a user. As one example, a chemical substance known as capsiason can be used to provide a tingle, a warm massage, or a soothing sensation to a user. In another example, spilanthol can be used to provide a residual tingle sensation as well as breathe freshening benefits. In another example, chamomile and lavender can be used to provide stress relief and relaxation benefits to the user. In yet another example, a flavoring can be used to enhance the user's enjoyment during cleansing of the mouth.

In yet other embodiments, the releasable material 1090 can comprise a chemical or medicament for oral benefits. For example, HUMPHRIES 3 or benzocaine can be used for pain relief. In another example, zo-caine type of medicines can be used as an appetite suppressant for weight loss treatment. In yet another example, the releasable material can be aspirin and the like. In an alternative construction, the releasable material may be a health supplement, such as a vitamin or mineral. Nevertheless, a wide variety of other chemicals which provide a medicinal or sensory response can be used with the oral care implement. Also, depending on the chemicals, a plurality of chemicals may be combined in tablets or the like of releasable material for multiple benefits.

Other suitable examples of the releasable material 1090 include antibacterial agents, whitening agents, glossing agents, anti-sensitivity agents, anti-inflammatory agents, anti-attachment agents, plaque indicator agents, flavorants, sensates, breath freshening agents, gum health agents and colorants. Examples of these agents include metal ion agents (e.g., stannous ion agents, copper ion agents, zinc ion agents, silver ion agents) triclosan; triclosan monophosphate, chlorhexidine, alexidine, hexetidine, sanguinarine, benzalkonium chloride, salicylanilide, domiphen bromide, cetylpyridinium chloride, tetradecylpyridinium chloride, N-tetradecyl-4-ethylpyridinium chloride (TDEPC), octenidine, delmopinol, octapinol, nisin, essential oils, furanones, bacteriocins, flavans, flavinoids, folic acids, vitamins, minerals, hydrogen peroxide, urea peroxide, sodium percarbonate, PVP-H2O2, polymer-bound peroxides, potassium nitrates, occluding agents, bioactive glass, arginine salts, arginine bicarbonate, bacalin, polyphenols, ethyl pyruvate, guanidinoethyl disulfide, tartar control agents, anti-stain ingredients, phosphate salts, polyvinylphosphonic acid, PVM/MA copolymers; enzymes, glucose oxidase, papain, ficin, ethyl lauroyl arginate, menthol, carvone, and anethole, various flavoring aldehydes, esters, and alcohols, spearmint oils, peppermint oil, wintergreen oil, sassafras oil, clove oil, sage oil, eucalyptus oil, marjoram oil, cinnamon oil, lemon oil, lime oil, grapefruit oil, and/or orange oil.

The releasable material(s) and/or its medium can be selected to complement a toothpaste formula, such as by coordinating flavors, colors, aesthetics, or active ingredients. A flavor can be administered to create a gradual flavor change during brushing, which presently is not possible using toothpaste alone. The flavor changes described here along with other changes in sensation can also be used as a signal for indicating that an effective brushing routine is complete. In one example, the flavorings could be released to indicate that an oral care element is functioning properly or to indicate that the implement is exhausted and ready to be disposed or refilled. A colorant can be added to create a color change during use. Flavor and/or color can also be used to signal another benefit, such as tooth whitening or anti-bacterial action.

The releasable material 1090 may be compatible with toothpaste, or may be unstable and/or reactive with typical toothpaste ingredients. The releasable material 1090 also may be a tooth cleaning agent to boost the overall efficacy of brushing.

The releasable material 1090 can be provided in any suitable vehicle, such as in aqueous solution or in the form of gel or paste. The vehicle can have a variety of different visual aesthetics including clear solution or gel or opaque solution or gel. Non-limiting examples of vehicles include water, monohydric alcohols such as ethanol, poly(ethylene oxides) such as polyethylene glycols such as PEG 2M, 5M, 7M, 14M, 23M, 45M, and 90M available from Union Carbide, carboxymethylene polymers such as Carbopol® 934 and 974 available from B.F. Goodrich, and combinations thereof. The selection of a suitable vehicle will be apparent to persons skilled in the art depending on such factors as the properties of the active agent and the desired properties of the medium, such as viscosity. Examples of tooth whitening compositions are described in U.S. Pat. Nos. 6,770,266 and 6,669,930, the disclosures of which are hereby incorporated by reference.

Embodiments are contemplated where a toothbrush constructed in accordance with the present invention comprises a plurality of releasable materials and/or active agents. For example, adjacent cushioned areas may carry the same or different oral care agents. Similarly, the same cushioned area can carry different oral care agents (A, B), either layered on top of each other for controlled release timing or adjacent to each other so they will react simultaneously when they come into contact with an activator.

The active oral care agents within one or more cushioned areas can function as, for example, abrasives, mouth fresheners, tooth whiteners, vitamins, anti-bacterial/anti-microbial agents, plaque dispersants, de-sensitizing agents for the mouth and teeth, anti-cavity agents, and/or combinations of these functional agents to provide individual or combined, synergistic benefits. Oral care agents can also include flavorings, decorations, nutritional and body supplements such as calcium. The calcium could, for example, be provided in 1 mg single use dosages. The flavorings could be released to indicate that an oral care element is functioning properly or to indicate that the instrument is exhausted and ready to be disposed or recharged. Also, the oral care agents could eliminate particular enzymes from within the mouth of the user. The decorations applied by the oral care agents could temporarily add coloring, sparkle, glitter and/or indicia to the teeth of the user. Further, the lack of fluid within the mouth could trigger an oral care agent, such as stimulant for the salivary gland, provided within the cushioned area. The amount and rate of delivery for these agents will depend on the amount needed and the agent being applied.

During the production of the oral care instrument, the oral care agents can be delivered to the cushioned areas in a solid and/or liquid compound. In one embodiment, the material of the oral care instrument is immersed in a desired liquid so that the oral care agent(s) within the liquid can flow and remain within the cushioned areas. As it dries, the oral care agent may become secure within the cushioned area. It is also possible to impregnate the cushioned areas with desired oral care agent (s) during production. For example, a material may be deposited within the cushioned area(s) which could retain the oral care agent(s). Some suitable examples include sponges. It is also understood that a spent oral care instrument, i.e., one in which the oral care agent(s) has been depleted, may advantageously be recharged with an oral care agent by immersing it again in a liquid that carries the desired oral care agent(s). The cushioned areas can be replenished (recharged) on a regular basis, including daily for those instruments providing single dosages of at least one oral care agent.

The releasable material 1090 may be in any suitable form. For example, the releasable material 1090 may be provided in the form of a gel capsule which holds and applies a mouth care solution for application to the oral cavity. The mouth care solution may be a toothpaste, a gel, a mouthwash, or similar dentifrice or oral hygiene product, or a combination of the same contained in a rupturable capsule. Preferably the gel capsule is a liquid-filled gel capsule having frangible, thin walls that easily rupture or burst when pressure is applied, when rubbed against hard oral surfaces, or dissolve when mixed with the saliva of a user. The materials making up gel capsule and the oral or mouth care solution contained therein preferably are consumable by the user, eliminating the need for water, a sink, or a waste receptacle to expectorate the gel capsule or its contents. The mouth care solution may remain in the gel capsule until the user applies pressure to either a carrier or soft tissue cleanser as described herein. Preferably, the gel capsule is fully sealed, helping the mouth care solution to remain fresh until use.

Embodiments are contemplated where the user may select from a variety of gel filled capsules to customize the desired effect. For example, during a brushing routine, the user may place a gel capsule having a dentifrice in the cushioned area and brush their teeth. Subsequently, the user may place a gel capsule having a whitening agent in the cushioned area to provide a whitening benefit. Various combinations of gel capsules can be selected. Some suitable chemistries and chemistry combinations were discussed previously and are similarly discussed hereafter. For such embodiments, the toothbrush may be sold along with a variety of gel capsules comprising chemistry for providing various benefits in a kit. As an example, a kit may include gel capsules having a dentifrice, having a whitening agent, having a tartar control agent, having an antimicrobial agent, having a breath freshening agent, having a re-mineralization agent, the like, and/or combinations thereof.

In use, the gel capsule would be rubbed against the teeth and burst, would be exposed to saliva and dissolve, or combinations thereof, thereby applying the mouth care solution over cleaning elements. The user then may brush their teeth with toothbrush. Embodiments are contemplated where a toothbrush constructed in accordance with the present invention includes at least one releasable material during brushing of the hard oral surfaces and at least one releasable material during cleaning of the soft tissue, e.g. tongue. An example would be a dentifrice and a mouth rinse. Additionally, as discussed previously, a toothbrush constructed in accordance with the present invention may include a plurality of carriers. Similarly, a toothbrush constructed in accordance with the present invention may comprise a plurality of releasable materials. Some of the releasable materials may be released simultaneously, while in some embodiments, releasable materials may be released sequentially.

In some embodiments, multiple oral care agents may be provided to the oral cavity. For example, the carrier(s) may dispense at least a first oral care agent, while a soft tissue cleanser dispenses at least a second oral care agent. Any suitable oral care agent may be utilized for the carrier(s) and/or the soft tissue cleanser(s). Some suitable examples were provided heretofore.

Other suitable examples of a first releasable material and a second releasable material are shown in Table 1 below.

| First Component | Second Component |
|---|---|
| A stannous salt, such as stannous chloride, stannous fluoride, stannous lactate, stannous gluconate, and combinations thereof. | A peroxide source, such as hydrogen peroxide or its precursors, and combinations thereof. |
| A stannous salt, such as stannous chloride, stannous fluoride, stannous lactate, stannous gluconate, and combinations thereof | A chlorite source, such as sodium chlorite, calcium chlorite, barium chlorite, magnesium chlorite, lithium chlorite, sodium chlorite, potassium chlorite, and combinations thereof. |
| A calcium salt, such as calcium fluoride, calcium chloride, calcium nitrate, calcium sulfate, calcium acetate, calcium gluconate, and combinations thereof. | A phosphate, such as phosphoric acid, or salts of phosphoric acid containing the $PO_4$ ion, as such acids or acid salts thereof, such as sodium phosphate monobasic, sodium phosphate dibasic, sodium phosphate tribasic, and combinations thereof. |
| A stannous salt, such stannous chloride, stannous fluoride, stannous lactate, and stannous gluconate; and/or/optionally with a quaternary ammonium compound, such as cetylpyridinium chloride; bis-guanides, such as chlorhexidine digluconate, hexetidine, octenidine, alexidine; and halogenated bisphenolic compounds, such as 2,2' methylenbis-(4-chloro-6-bromophenol)); and/or/optionally in combination with a flavor, such as peppermint oil, spearmint oil, eucalyptus oil, aniseed oil, fennel oil, caraway oil, methyl acetate, cinnamaldehyde, anethol, vanillin, thymol and other natural or nature-identical essential oils or synthetic flavors; and combinations of the foregoing | An abrasive, such as carbonates (e.g., sodium bicarbonate, calcium carbonate) water-colloidal silica, precipitated silicas (e.g., hydrated silica), sodium aluminosilicates, silica grades containing alumina, hydrated alumina, dicalcium phosphates, insoluble sodium metaphosphate, and magnesiums (e.g., trimagnesium phosphate); and/or/optionally in combination with a surfactant (e.g., anionic, nonionic, cationic and zwitterionic or amphoteric compositions), such as soaps, sulfates(e.g., sodium lauryl sulfate and sodium dodecyl benzene sulfonate), sodium lauryl sarcosinate, sorbitan esters of fatty acids, sulfobetaines (e.g., cocamidopropylbatine), and D-glucopyranoside $C_{10-16}$ alkyl oligomeric; and combinations of the foregoing. |

-continued

| First Component | Second Component |
|---|---|
| A phosphate, such as phosphoric acid, or salts of phosphoric acid containing the $PO_4$ ion, as such acids or acid salts thereof, such as sodium phosphate monobasic, sodium phosphate dibasic, sodium phosphate tribasic, and combinations thereof. | A calcium salt, such as calcium fluoride, calcium chloride, calcium nitrate, calcium sulfate, calcium acetate, calcium gluconate, and combinations thereof. |
| A fluoride source, such as sodium fluoride, zinc fluoride, betaine fluoride, alanine stannous fluoride, hexylamine fluoride, at a pH between about 2 and about 6, and combinations thereof | Any composition with a pH greater that about 7. |
| A first flavor, such as peppermint oil, spearmint oil, eucalyptus oil, aniseed oil, fennel oil, caraway oil, methyl acetate, cinnamaldehyde, anethol, vanillin, thymol and other natural or nature-identical essential oils or synthetic flavors, and combinations thereof. | A second flavor, such as peppermint oil, spearmint oil, eucalyptus oil, aniseed oil, fennel oil, caraway oil, methyl acetate, cinnamaldehyde, anethol, vanillin, thymol and other natural or nature-identical essential oils or synthetic flavors, and combinations thereof. |
| A quaternary ammonium compound, such as cetylpyridinium chloride; bis-guanides, such as chlorhexidine digluconate, hexetidine, octenidine, alexidine; and halogenated bisphenolic compounds, such as 2,2' methylenbis-(4-chloro-6-bromophenol)); and combinations thereof. | A peroxide source, such as hydrogen peroxide or its precursors, and combinations thereof. |
| A flavor, such as peppermint oil, spearmint oil, eucalyptus oil, aniseed oil, fennel oil, caraway oil, methyl acetate, cinnamaldehyde, anethol, vanillin, thymol and other natural or nature-identical essential oils or synthetic flavors, and combinations thereof. | A peroxide source, such as hydrogen peroxide or its precursors, and combinations thereof. |
| A quaternary ammonium compound, such as cetylpyridinium chloride; bis-guanides, such as chlorhexidine digluconate, hexetidine, octenidine, alexidine; and halogenated bisphenolic compounds, such as 2,2' methylenbis-(4-chloro-6-bromophenol)); and combinations thereof. | A chlorite source, such as sodium chlorite, calcium chlorite, barium chlorite, magnesium chlorite, lithium chlorite, sodium chlorite, potassium chlorite, and combinations thereof. |
| A flavor, such as peppermint oil, spearmint oil, eucalyptus oil, aniseed oil, fennel oil, caraway oil, methyl acetate, cinnamaldehyde, anethol, vanillin, thymol and other natural or nature-identical essential oils or synthetic flavors, and combinations thereof. | A chlorite source, such as sodium chlorite, calcium chlorite, barium chlorite, magnesium chlorite, lithium chlorite, sodium chlorite, potassium chlorite, and combinations thereof. |
| A calcium salt, such as calcium fluoride, calcium chloride, calcium nitrate, calcium sulfate, calcium acetate, calcium gluconate, and combinations thereof. | A fluoride source, such as sodium fluoride, zinc fluoride, betaine fluoride, alanine stannous fluoride, hexylamine fluoride, and combinations thereof. |
| A fluoride source, such as sodium fluoride, zinc fluoride, betaine fluoride, alanine stannous fluoride, hexylamine fluoride, and combinations thereof. | A calcium salt, such as calcium fluoride, calcium chloride, calcium nitrate, calcium sulfate, calcium acetate, calcium gluconate, and combinations thereof. |
| A disclosing agent, such as fluoroscein, dibromofluoroscein, tribromofluoroscein, tetrabromofluoroscein, other fluorescein derivatives (including salts thereof), xanthenes, pyrenes, e.g. pyranine, D&C Blue No. 1, D&C Blue No. 2, D&C Green No. 3, D&C Red No. 3, D&C Red No. 6, D&C Red No. 7, D&C Red No. 21, D&C Red No. 22, D&C Red No. 27, D&C Red No. 28, D&C Red No. 33, D&C Red No. 40, D&C Yellow No. 5, D&C Yellow No. 6, D&C Yellow No. 10, combinations thereof or any other dye approved for use in drugs and cosmetics by regulatory agencies, and combinations thereof. | An abrasive, such as carbonates (e.g., sodium bicarbonate, calcium carbonate) water-colloidal silica, precipitated silicas (e.g., hydrated silica), sodium aluminosilicates, silica grades containing alumina, hydrated alumina, dicalcium phosphates, insoluble sodium metaphosphate, and magnesiums (e.g., trimagnesium phosphate); and/or/optionally in combination with a surfactant (e.g., anionic, nonionic, cationic and zwitterionic or amphoteric compositions), such as soaps, sulfates(e.g., sodium lauryl sulfate and sodium dodecyl benzene sulfonate), sodium lauryl sarcosinate, sorbitan esters of fatty acids, sulfobetaines (e.g., cocamidopropylbatine), and D-glucopyranoside $C_{10-16}$ alkyl oligomeric, and combinations of the foregoing. |
| An abrasive, such as carbonates (e.g., sodium bicarbonate, calcium carbonate) water-colloidal silica, precipitated silicas (e.g., hydrated silica), sodium aluminosilicates, silica grades containing alumina, hydrated alumina, dicalcium phosphates, insoluble sodium | A disclosing agent, such as fluoroscein, dibromofluoroscein, tribromofluoroscein, tetrabromofluoroscein, other fluorescein derivatives (including salts thereof), xanthenes, pyrenes, e.g. pyranine, D&C Blue No. 1, D&C Blue No. 2, D&C Green No. 3, D&C Red No. 3, D&C Red No. 6, D&C Red |

-continued

| First Component | Second Component |
|---|---|
| metaphosphate, and magnesiums(e.g., trimagnesium phosphate); and/or/optionally in combination with a surfactant (e.g., anionic, nonionic, cationic and zwitterionic or amphoteric compositions), such as soaps, sulfates (e.g., sodium lauryl sulfate and sodium dodecyl benzene sulfonate), sodium lauryl sarcosinate, sorbitan esters of fatty acids, sulfobetaines (e.g., cocamidopropylbatine), and D-glucopyranoside $C_{10-16}$ alkyl oligomeric; and combinations of the foregoing. | No. 7, D&C Red No. 21, D&C Red No. 22, D&C Red No. 27, D&C Red No. 28, D&C Red No. 33, D&C Red No. 40, D&C Yellow No. 5, D&C Yellow No. 6, D&C Yellow No. 10, combinations thereof or any other dye approved for use in drugs and cosmetics by regulatory agencies, and combinations thereof. |
| A calcium salt, such as calcium fluoride, calcium chloride, calcium nitrate, calcium sulfate, calcium acetate, calcium gluconate, and combinations thereof. | A phosphate, such as phosphoric acid, or salts of phosphoric acid containing the $PO_4$ ion, as such acids or acid salts thereof, such as sodium phosphate monobasic, sodium phosphate dibasic, and sodium phosphate tribasic; in combination with a fluoride source, such as sodium fluoride, zinc fluoride, betaine fluoride, alanine stannous fluoride, hexylamine fluoride; and combinations of the foregoing. |
| A zinc salt, such as zinc nitrate, zinc citrate, zinc chloride, zinc sulfate, zinc bicarbonate, zinc oxalate, zinc fluoride, zinc lactate, zinc gluconate, and combinations thereof. | A peroxide source, such as hydrogen peroxide or its precursors, and combinations thereof. |
| A zinc salt, such as zinc nitrate, zinc citrate, zinc chloride, zinc sulfate, zinc bicarbonate, zinc oxalate, zinc fluoride, zinc lactate, zinc gluconate, and combinations of the foregoing. | A chlorite source, such as sodium chlorite, calcium chlorite, barium chlorite, magnesium chlorite, lithium chlorite, sodium chlorite, potassium chlorite, and combinations of the foregoing. |
| A copper salt, such as copper gluconate, copper chlorate, copper chloride, copper fluoride, copper nitrate, and combinations of thereof. | A chlorite source, such as sodium chlorite, calcium chlorite, barium chlorite, magnesium chlorite, lithium chlorite, sodium chlorite, potassium chlorite, and combinations thereof. |
| A copper salt, such as copper gluconate, copper chlorate, copper chloride, copper fluoride, copper nitrate, and combinations thereof. | A peroxide source, such as hydrogen peroxide or its precursors, and combinations thereof. |
| A peroxide source, such as hydrogen peroxide and its precursors, and combinations thereof. | A metal catalyst, such as iron, copper, manganese, and molybdate, and combinations thereof. |
| A metal catalyst, such as iron, copper, manganese, and molybdate, and combinations thereof. | A peroxide source, such as hydrogen peroxide or its precursors, and combinations thereof. |
| A stannous salt, such as stannous chloride, stannous fluoride, stannous lactate, stannous gluconate, and combinations thereof. | A pyrophosphate salt, such as dialkali or tetraalkali metal pyrophosphate salts such as $Na_4P_2O_7$(TSPP), $K_4P_2O_7$, $Na_2K_2P_2O_7$, $Na_2H_2P_2O_7$ and $K_2H_2P_2O_7$, and wherein the polyphosphate salt may include the water soluble alkali metal tripolyphosphates such as sodium tripolyphosphate and potassium tripolyphosphate; and/or/optionally in combination with polyphosphate, such as sodium hexametaphosphate or any polyphosphate $(PO_4)_n$, where n is 2 to 40; and combinations of the foregoing. |
| A pyrophosphate salt, such as dialkali or tetraalkali metal pyrophosphate salts such as $Na_4P_2O_7$(TSPP), $K_4P_2O_7$, $Na_2K_2P_2O_7$, $Na_2H_2P_2O_7$ and $K_2H_2P_2O_7$, and wherein the polyphosphate salt may include the water soluble alkali metal tripolyphosphates such as sodium tripolyphosphate and potassium tripolyphosphate; and/or/optionally in combination with a polyphosphate, such as sodium hexametaphosphate or any polyphosphate $(PO_4)_n$, where n is 2 to 40; and combinations of the foregoing. | A stannous salt, such as stannous chloride, stannous fluoride, stannous lactate, stannous gluconate, and combinations thereof. |
| A zinc salt, such as zinc nitrate, zinc citrate, zinc chloride, zinc sulfate, zinc bicarbonate, zinc oxalate, zinc fluoride, zinc lactate, zinc gluconate, and combinations thereof. | A pyrophosphate salt, such as dialkali or tetraalkali metal pyrophosphate salts such as $Na_4P_2O_7$(TSPP), $K_4P_2O_7$, $Na_2K_2P_2O_7$, $Na_2H_2P_2O_7$ and $K_2H_2P_2O_7$. and wherein the polyphosphate salt may include the water soluble alkali metal tripolyphosphates such as sodium tripolyphosphate and potassium tripolyphosphate; and/or/optionally in combination with a polyphosphate, such as |

-continued

| First Component | Second Component |
|---|---|
| | sodium hexametaphosphate or any polyphosphate $(PO_4)_n$, where n is 2 to 40; and combinations of the foregoing. |
| A pyrophosphate salt, such as dialkali or tetraalkali metal pyrophosphate salts such as $Na_4P_2O_7$(TSPP), $K_4P_2O_7$, $Na_2K_2P_2O_7$, $Na_2H_2P_2O_7$ and $K_2H_2P_2O_7$, and wherein the polyphosphate salt may include the water soluble alkali metal tripolyphosphates such as sodium tripolyphosphate and potassium tripolyphosphate; and/or/optionally in combination with a polyphosphate, such as sodium hexametaphosphate or any polyphosphate $(PO_4)_n$, where n is 2 to 40; and combinations of the foregoing. | A zinc salt, such as zinc nitrate, zinc citrate, zinc chloride, zinc sulfate, zinc bicarbonate, zinc oxalate, zinc fluoride, zinc lactate, zinc gluconate, and combinations thereof. |
| A copper salt, such as copper gluconate, copper chlorate, copper chloride, copper fluoride, copper nitrate, and combinations thereof. | A pyrophosphate salt, such as dialkali or tetraalkali metal pyrophosphate salts such as $Na_4P_2O_7$(TSPP), $K_4P_2O_7$, $Na_2K_2P_2O_7$, $Na_2H_2P_2O_7$ and $K_2H_2P_2O_7$, and wherein the polyphosphate salt may include the water soluble alkali metal tripolyphosphates such as sodium tripolyphosphate and potassium tripolyphosphate; and/or/optionally in combination with a polyphosphate, such as sodium hexametaphosphate or any polyphosphate $(PO_4)_n$, where n is 2 to 40; and combinations of the foregoing. |
| A pyrophosphate salt, such as dialkali or tetraalkali metal pyrophosphate salts such as $Na_4P_2O_7$(TSPP), $K_4P_2O_7$, $Na_2K_2P_2O_7$, $Na_2H_2P_2O_7$ and $K_2H_2P_2O_7$, and wherein the polyphosphate salt may include the water soluble alkali metal tripolyphosphates such as sodium tripolyphosphate and potassium tripolyphosphate; and/or/optionally in combination with a polyphosphate, such as sodium hexametaphosphate or any polyphosphate $(PO_4)_n$, where n is 2 to 40; and combinations of the foregoing. | A copper salt, such as copper gluconate, copper chlorate, copper chloride, copper fluoride, copper nitrate, and combinations thereof. |
| A metal salt, such as stannous, copper, zinc, silver, tin, manganese, iron, magnesium, and combinations thereof. | A pyrophosphate salt, such as dialkali or tetraalkali metal pyrophosphate salts such as $Na_4P_2O_7$(TSPP), $K_4P_2O_7$, $Na_2K_2P_2O_7$, $Na_2H_2P_2O_7$ and $K_2H_2P_2O_7$, and wherein the polyphosphate salt may include the water soluble alkali metal tripolyphosphates such as sodium tripolyphosphate and potassium tripolyphosphate; and/or/optionally in combination with a polyphosphate, such as sodium hexametaphosphate or any polyphosphate $(PO_4)_n$, where n is 2 to 40; and combinations of the foregoing. |
| A pyrophosphate salt, such as dialkali or tetraalkali metal pyrophosphate salts such as $Na_4P_2O_7$(TSPP), $K_4P_2O_7$, $Na_2K_2P_2O_7$, $Na_2H_2P_2O_7$ and $K_2H_2P_2O_7$, and wherein the polyphosphate salt may include the water soluble alkali metal tripolyphosphates such as sodium tripolyphosphate and potassium tripolyphosphate; and/or/optionally in combination with a polyphosphate, such as sodium hexametaphosphate or any polyphosphate $(PO_4)_n$, where n is 2 to 40; and combinations of the foregoing. | A metal salt, such as stannous, copper, zinc, silver, tin, manganese, iron, magnesium and combinations thereof |
| A metal salt, such as stannous, copper, zinc, silver, tin, manganese, iron, magnesium and combinations thereof | An oxidizer, such as chlorite salts, hydrogen peroxide (or a peroxide source), perborates, perchlorates, hyperchlorates, and combinations thereof. |
| An anti-bacterial agent, such as triclosan (2,4,4-trichloro-2'-hydroxy-diphenyl ether), chlorhexidine, copper-, zinc-and stannous salts such as zinc citrate, zinc sulfate, zinc glycinate, sanguinarine extract, metronidazole, quaternary ammonium compounds, such as cetylpyridinium chloride; bis-guanides, such as chlorhexidine digluconate, hexetidine, octenidine, alexidine; and halogenated bisphenolic compounds, such as 2,2' | A polyphosphate, such as sodium hexametaphosphate or any polyphosphate $(PO_4)_n$, where n is 2 to 40; and/or/optionally with an oxidizer, such as chlorite salts, hydrogen peroxide, perborates, perchlorates, and hyperchlorates; and/or/optionally with a chelant, such as alkali metal stannates such as sodium and potassium stannate, ethylenediaminetetracetic acid (EDTA) and its salts, citrate, and malate and salts and acids thereof; and combinations of the foregoing. |

-continued

| First Component | Second Component |
|---|---|
| methylenbis-(4-chloro-6-bromophenol)), and combinations thereof. | |
| A disclosing agent, such as fluoroscein, dibromofluoroscein, tribromofluoroscein, tetrabromofluoroscein, other fluorescein derivatives (including salts thereof), xanthenes, pyrenes, e.g. pyranine, D&C Blue No. 1, D&C Blue No. 2, D&C Green No. 3, D&C Red No. 3, D&C Red No. 6, D&C Red No. 7, D&C Red No. 21, D&C Red No. 22, D&C Red No. 27, D&C Red No. 28, D&C Red No. 33, D&C Red No. 40, D&C Yellow No. 5, D&C Yellow No. 6, D&C Yellow No. 10, combinations thereof or any other dye approved for use in drugs and cosmetics by regulatory agencies, and combinations thereof. | A polyphosphate, such as sodium hexametaphosphate or any polyphosphate $(PO_4)_n$, where n is 2 to 40; and/or/optionally with an oxidizer, such as chlorite salts, hydrogen peroxide, perborates, perchlorates, and hyperchlorates; and/or/optionally with a chelant, such as alkali metal stannates such as sodium and potassium stannate, ethylenediaminetetracetic acid (EDTA) and its salts, citrate, and malate and salts and acids thereof; and combinations of the foregoing. |
| A stannous salt, such as stannous chloride, stannous fluoride, stannous lactate, stannous gluconate, and combinations thereof. | A quaternary ammonium compound, such as cetylpyridinium chloride; bis-guanides, such as chlorhexidine digluconate, hexetidine, octenidine, alexidine; and halogenated bisphenolic compounds, such as 2,2' methylenbis-(4-chloro-6-bromophenol)); and combinations thereof; in combination with a peroxide source, such as hydrogen peroxide or its precursors, and combinations thereof. |
| Anionic antibacterial agent, e.g. fluoride | Cationic antibacterial agent, e.g. cetylpyridinium chloride |
| Cationic antibacterial agent, e.g. cetylpyridinium chloride | Non-inonic antibacterial agent, e.g. triclosan |
| Flouride + Any composition with a pH less than about 7. | Any composition with a pH greater that about 7. |
| Metal, non catalytic, e.g., stannous, zinc | Peroxide |
| Cationic antibacterial, e.g. stannous fluoride | Anionic Stain control, e.g. linear polyphosphate, ring phosphates, e.g. phytic acid |
| Non-ionic stain control, e.g. fatty alcohols | Linear polyphosphates |
| Bleaching activator, e.g. cationic (zinc, stannous) | Peroxide |

Figure 11A:
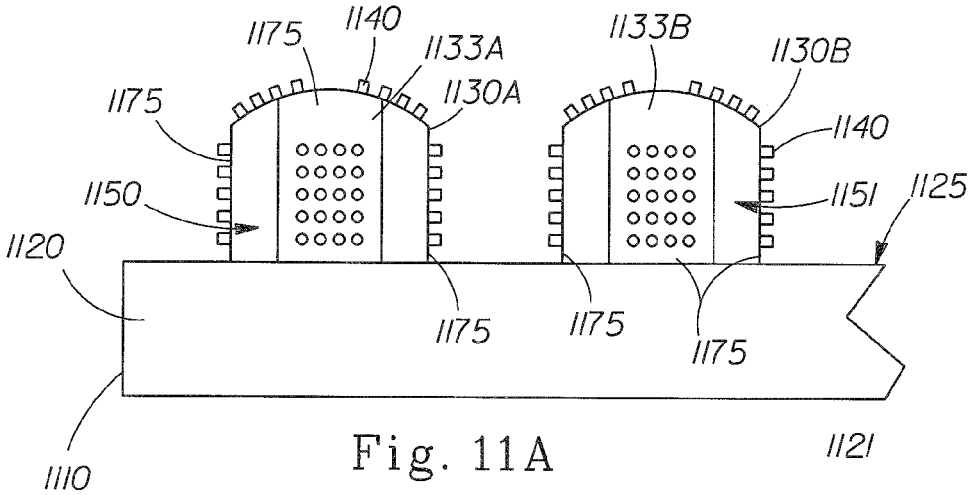
FIG. 11A shows a side view of a toothbrush of another embodiment of the present invention.

Additional structures are contemplated for the carriers. For example, as shown in FIG. 11A, a toothbrush constructed in accordance with the present invention may comprise a plurality of carriers 1130A and 1130B. Embodiments are contemplated where the toothbrush comprises at least one carrier either 1130A and/or 1130B. As shown, the carriers 1130A and/or 1130B are disposed generally inboard of a free end 1110 and an attachment end 1121 of the base 1120. However, the carriers 1130A and/or 1130B may be disposed at any suitable location.

The carriers 1130A and 1130B may each comprise a support 1133A and 1133B, respectively, and a plurality of cleaning elements 1140. The supports 1133A and/or 1133B may be configured similarly to the supports described herein. The supports 1133A and/or 1133B may comprise wall portions 1175. As shown, at least some of the wall portions 1175 are oriented generally parallel to a longitudinal axis, and at least some of the wall portions 1175 are oriented generally parallel to a lateral axis. The wall portions 1175 may be oriented in any suitable manner. For example, the wall portions 1175 may be positioned at an angle with respect to the longitudinal axis and/or the later axis.

As shown, the wall portions 1175 are positioned in a generally vertical orientation. Between adjacent wall members is an opening 1150 and 1151. The wall portions 1175 may be configured such that a cavity is formed within each of the carriers 1130A and/or 1130B. At least one of the cavities may comprise the releasable material described heretofore. The releasable material may be released via the openings 1150 and/or 1151. In some embodiments, the carrier 1130A may comprise a first releasable material and the second carrier 1130B may comprise a second releasable material. The first releasable material and the second releasable material may be as described heretofore.

Figure 11B:
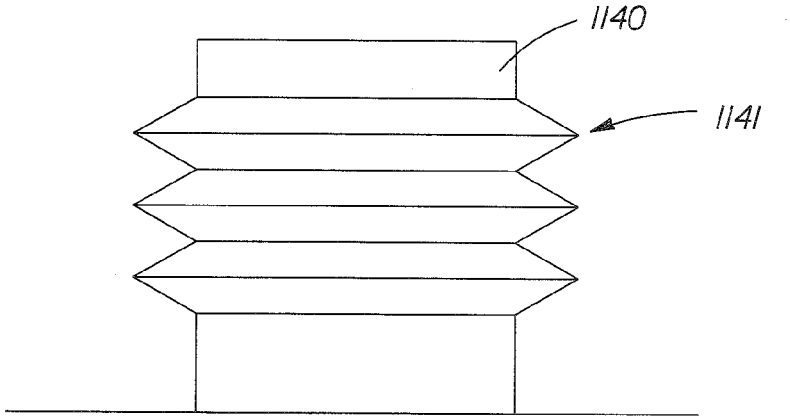
FIG. 11B shows a close up view of a cleaning element constructed in accordance with the present invention.

As shown, each of the carriers 1130A and/or 1130B may comprise a plurality of cleaning elements. As shown in FIG. 11B, the cleaning elements 1140 may comprise a textured portion 1141. The textured portion 1141 may comprise a plurality of ribs, dimples, and/or any other suitable structure. The textured portion 1141 may surround the cleaning element 1140 or may be positioned on faces of the cleaning element 1140 which are generally parallel to the lateral axis. The textured portion 1141 may be integral with the cleaning element 1140. For example, the cleaning element 1140 may be injection molded, created, fabricated, machined, and/or the like, as one piece. In some embodiments, the textured portion 1141 may be attached to the cleaning element 1140. For example, the textured element 1141 may be injection molded onto the cleaning element 1141. The textured portion 1141 can provide better cleaning efficacy for the cleaning element 1140.

The carriers 1130A and/or 1130B may be incorporated with any of the embodiments described herein. Additionally, any of the carriers described herein may be further utilized with other traditional elements. For example, a carrier as described herein may be used in conjunction with a plurality of bristle tufts. In such embodiments, the carrier and the bristle tufts may be attached to a base in any suitable manner. The bristle tufts may be positioned adjacent the carrier or may be configured such that the bristle tufts extend through the carrier.

A handle as disclosed herein may comprise any suitable material. Some suitable examples include polymers, such as polypropylene, polyurethane, polyethylene, as well as copolymers and thermoplastic elastomers. Combinations of materials may be used for performance, i.e., bonding, flexibility and gripping, as well as appearance benefits.

In addition to better cleaning, the conformity of this device facilitates applying treatments to the oral cavity, both hard and soft tissue, thus it can serve as an applicator as well as a toothbrush.

The handle, carrier(s), and/or soft tissue cleanser(s), as disclosed herein may be manufactured via any suitable process. An example of a suitable process is injection molding. For example, the handle comprising a first material may be injection molded initially. The carriers) may then be injection molded to the handle, wherein the carriers) and/or soft tissue cleanser(s) comprise a second material. In some embodiments, the handle, carrier(s), and/or soft tissue cleanser(s) may be injection molded at the same time such that the handle, carriers) and/or soft tissue cleanser(s) are integral with one another. In such embodiments, cleaning elements may similarly be created in this injection molding step for both the carriers) and/or the soft tissue cleanser(s).

The carriers described herein may be used in conjunction with conventional cleaning elements e.g. bristle tufts, fins, elastomeric fins, elastomeric cups, elastomeric walls, the like, and/or combinations thereof.

The carriers described herein may be utilized in any suitable manner. For example, a pair of carriers may be laterally spaced apart with open areas extending generally parallel to a longitudinal axis of the oral care device. As yet another example, a first plurality of carriers may be laterally spaced apart with open areas extending generally parallel to a lateral axis of a head of the oral care device. As yet another example, a first plurality of carriers may be laterally spaced apart and have open areas extending generally parallel to the lateral axis of the head, and a second plurality of carriers may be longitudinally spaced apart from the first pair and have open areas extending generally parallel to the lateral axis. As yet another example, a first plurality of carriers may be spaced apart laterally and have open areas extending generally parallel to the longitudinal axis, and a second plurality of carriers may be longitudinally spaced from the first plurality and have open areas extending generally parallel to the lateral axis. As yet another example, a first plurality of carriers may be laterally spaced apart where at least one of the first plurality has an open area extending generally parallel to the longitudinal axis, and at least one of the first plurality of carriers has an open area extending generally parallel to the lateral axis.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A toothbrush head comprising:

a base portion and at least one cleaning portion, the at least one cleaning portion including an injection-molded unitary element comprising a support and a plurality of cleaning elements integrally formed with the support, the support having an outer side and an inner side opposite to the outer side, the plurality of cleaning elements outwardly extending from the outer side of the support, wherein the cleaning portion is attached to the base portion at a first end and a second end, wherein a mid-section of the cleaning portion is elevated above the base portion such that an opening is created between the base portion and the inner side of the cleaning portion and wherein the outer side of the support having the plurality of cleaning elements thereon defines a top surface of the cleaning portion, and wherein the opening extends along a longitudinal axis of the head.

2. The toothbrush head of claim 1, wherein the support has a thickness of up to about 3 mm.

3. The toothbrush head of claim 2, wherein the support and the cleaning elements are unitary.

4. The toothbrush head of claim 2, wherein the thickness of the support varies along the longitudinal axis of the head.

5. The toothbrush head of claim 4, wherein the head has a free end and an attachment end, wherein the thickness of the support at the free end is greater than the thickness of the support at the attachment end.

6. The toothbrush head of claim 1, wherein the first end and the second end are adjacent sides of the head.

7. The toothbrush head of claim 1, wherein the cleaning portion further comprises a forward section which is attached to the free end.

8. The toothbrush head of claim 1, further comprising an oral care agent disposed within the opening.

9. The toothbrush head of claim 8, wherein the oral care agent is disposed on a foam structure within the opening.

10. The toothbrush head of claim 1, wherein the cleaning portion comprises at least one aperture extending therethrough.

11. The toothbrush head of claim 10, wherein the aperture comprises a serpentine split.

12. The toothbrush head of claim 1, wherein the cleaning portion comprises a first section and a second section, the first section being disposed adjacent a free end of the head and the second section being disposed adjacent an attachment end of the head, the first section comprising a first material and the second section comprising a second material, wherein the first material is different than the second material.

13. The toothbrush head of claim 1, wherein the toothbrush head includes a first oral-care agent comprising an antibacterial composition housed in the opening created between the base portion and the inner side of the cleaning portion.

14. The toothbrush head of claim 13, wherein the toothbrush head comprises at least two cleaning portions and at least two corresponding openings, each created between the base portion and the inner side of the cleaning portion.

15. The toothbrush head of claim 14, wherein the toothbrush head comprises a second oral-care agent housed in the opening created between the base portion and the inner side of at least one of the two cleaning portions.

16. The toothbrush head of claim 15, wherein the first oral-care agent comprises a stannous salt and the second oral-care agent comprises a quaternary ammonium compound.

17. The toothbrush head according to claim 1, wherein the toothbrush head includes a soft-tissue cleanser comprising a cleanser support and a plurality of cleanser elements integrally formed with the support, the cleanser support having an outer side and an inner side opposite to the outer side, the plurality of cleanser elements outwardly extending from the outer side of the cleanser support, wherein a cushioned area is created between the cleanser support and the base portion.

18. The toothbrush head of claim 17, wherein the base portion has a first side and a second side opposite to the first side, and wherein the at least one cleaning portion is disposed on the first side of the base portion, and the soft-tissue cleanser is disposed on the second side of the base portion.

19. A toothbrush head comprising:

a base having a free end and an attachment end; and at least one cleaning portion having a first end and a second end, the first end and the second end being attached to the base, the cleaning portion including an injection-molded element comprising a support and a plurality of cleaning elements integrally formed with the support, the support having an outer side and an inner side opposite to the outer side, wherein the plurality of cleaning elements outwardly extends from the outer side of the support, wherein a mid-section of the cleaning portion is elevated above the base such that an opening is created between the base and the inner side of the cleaning portion and wherein the outer side of the support having the plurality of cleaning elements thereon defines a top surface of the cleaning portion, and wherein the opening extends along a lateral axis of the head.

20. The toothbrush head of claim 19, wherein the toothbrush head comprises a soft tissue cleanser, the soft tissue cleanser having a Shore A hardness of at least 80.

21. The toothbrush head of claim 19, the toothbrush head comprising at least one antibacterial oral-care agent disposed in the opening created between the base and the inner side of the at least one cleaning portion.

* * * * *